US009950884B2

(12) United States Patent
Kuriki

(10) Patent No.: US 9,950,884 B2
(45) Date of Patent: Apr. 24, 2018

(54) SHEET FEEDER CAPABLE OF SUPPRESSING INCREASE IN SIZE

(71) Applicant: Brother Kogyo Kabushiki Kaisha, Nagoya-shi, Aichi-ken (JP)

(72) Inventor: Yuichiro Kuriki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/054,351

(22) Filed: Feb. 26, 2016

(65) Prior Publication Data

US 2016/0251174 A1 Sep. 1, 2016

(30) Foreign Application Priority Data

Feb. 27, 2015 (JP) ..... 2015-037550

(51) Int. Cl.
*B65H 3/06* (2006.01)
*B65H 3/34* (2006.01)
(Continued)

(52) U.S. Cl.
CPC ..... *B65H 3/0669* (2013.01); *B65H 3/063* (2013.01); *B65H 3/0653* (2013.01); *B65H 3/34* (2013.01);
(Continued)

(58) Field of Classification Search
CPC ..... B65H 3/34; B65H 3/56; B65H 2404/623
See application file for complete search history.

(56) References Cited

U.S. PATENT DOCUMENTS 4,548,395 A 10/1985 Snellman et al.
4,971,310 A 11/1990 Motegi et al.
(Continued)

FOREIGN PATENT DOCUMENTS

JP S63-71044 A 3/1988
JP H07-10313 A 1/1995
(Continued)

OTHER PUBLICATIONS

Jun. 23, 2016—U.S. Non-Final Office Action—U.S. Appl. No. 15/054,383.
(Continued)

*Primary Examiner* — Howard J Sanders
(74) *Attorney, Agent, or Firm* — Banner & Witcoff, Ltd.

(57) ABSTRACT

A sheet feeder includes: a first roller; a separation member; a shutter; a pressing portion; and a cam portion. The separation member contacts the first roller at a contact position. An axis of the shutter is positioned downstream of the separation member in a conveying direction. The shutter is movable between first and second positions. The shutter in the first position has a portion positioned upstream of the contact position in the conveying direction. The pressing portion is positioned upstream of the separation member and the shutter in the first position in the conveying direction. The pressing portion is movable between third and fourth positions. The pressing portion in the third position faces the first roller. The pressing portion in the fourth position is separated from the first roller farther than in the third position. The cam portion is positioned upstream of the pressing portion in the conveying direction.

12 Claims, 27 Drawing Sheets

(51) Int. Cl.
*B65H 3/52* (2006.01)
*B65H 3/56* (2006.01)

(52) U.S. Cl.
CPC ..... *B65H 3/5284* (2013.01); *B65H 3/56* (2013.01); *B65H 2402/32* (2013.01); *B65H 2402/46* (2013.01); *B65H 2402/543* (2013.01); *B65H 2403/51* (2013.01); *B65H 2403/942* (2013.01); *B65H 2404/133* (2013.01); *B65H 2404/152* (2013.01); *B65H 2404/623* (2013.01)

(56) References Cited

U.S. PATENT DOCUMENTS

| | | | | |
|---|---|---|---|---|
| 5,219,156 | A | 6/1993 | Mori | |
| 5,230,503 | A | 7/1993 | Saito et al. | |
| 7,523,933 | B2 | 4/2009 | Linder et al. | |
| 7,621,522 | B2 | 11/2009 | Yasukawa et al. | |
| 8,757,611 | B2 * | 6/2014 | Shih | B65H 3/54 271/121 |
| 8,985,570 | B1 | 3/2015 | Fang et al. | |
| 9,340,381 | B2 | 5/2016 | Matsushita et al. | |
| 2008/0203652 | A1 * | 8/2008 | Yasukawa | B65H 3/063 271/117 |
| 2008/0285097 | A1 | 11/2008 | Kitagawa et al. | |
| 2009/0212482 | A1 | 8/2009 | Claris et al. | |
| 2010/0276867 | A1 | 11/2010 | Sheng et al. | |
| 2012/0113488 | A1 | 5/2012 | Machida et al. | |
| 2014/0131939 | A1 | 5/2014 | Shih | |
| 2016/0251178 | A1 * | 9/2016 | Kuriki | B65H 5/062 271/273 |
| 2016/0251179 | A1 * | 9/2016 | Kuriki | B65H 31/20 271/274 |

FOREIGN PATENT DOCUMENTS

| | | | |
|---|---|---|---|
| JP | H09-110224 | A | 4/1997 |
| JP | 2003-040460 | A | 2/2003 |
| JP | 2008-169026 | A | 7/2008 |
| JP | 2008-207944 | A | 9/2008 |
| JP | 2008-285259 | A | 11/2008 |

OTHER PUBLICATIONS

Feb. 26, 2016—U.S. Co-Pending Application—U.S. Appl. No. 15/054,438.
Feb. 26, 2016—U.S. Co-Pending Application—U.S. Appl. No. 15/054,383.
Oct. 31, 2016—U.S. Non-Final Office Action—U.S. Appl. No. 15/054,438.
Dec. 23, 2016—U.S. Final Office Action—U.S. Appl. No. 15/054,383.
Apr. 13, 2017—U.S. Notice of Allowance—U.S. Appl. No. 15/054,438.
May 5, 2017—U.S. Non-Final Office Action—U.S. Appl. No. 15/054,383.
Oct. 24, 2017—U.S. Non-Final Office Action—U.S. Appl. No. 15/054,383.

* cited by examiner

SHEET FEEDER CAPABLE OF SUPPRESSING INCREASE IN SIZE

CROSS REFERENCE TO RELATED APPLICATION

This application claims priority from Japanese Patent Application No. 2015-037550 filed Feb. 27, 2015. The entire content of the priority application is incorporated herein by reference. The present application relates to a co-pending US patent application (based on Japanese patent application No. 2015-037548 filed Feb. 27, 2015) and another co-pending US patent application (based on Japanese patent application No. 2015-037549 filed Feb. 27, 2015) which are incorporated herein by reference.

TECHNICAL FIELD

The present disclosure relates to a sheet feeder that conveys sheets.

BACKGROUND

There is conventionally known a sheet feeder provided with a mechanism for separating one sheet from a plurality of stacked sheets and conveying the separated sheet. This conventional sheet feeder includes a first roller, a second roller, and a pick arm. The first roller conveys a plurality of sheets stacked on a shooter downstream in a conveying direction. The second roller restrains sheets other than the bottommost sheet from being conveyed downstream.

The pick arm can move in a direction toward the first roller and a direction away from the first roller. The pick arm rotatably supports a third roller and a flap at a portion of the pick arm positioned nearest the first roller. A spring urges the flap to rotate in a first direction. When the pick arm is moved toward the first roller, the third roller contacts the topmost sheet, and the flap is inserted into a conveying path at a position downstream of the plurality of sheets. When the plurality of sheets is conveyed downstream, the sheets push the flap downstream, causing the flap to rotate in a second direction opposite the first direction so as to be retracted from the conveying path.

SUMMARY

According to one aspect, the disclosure provides a sheet feeder including: a casing; a first roller; a separation member; a shutter; a pressing portion; and a cam portion. The casing defines therein a conveying region through which a sheet is conveyed in a conveying direction. The first roller has a first rotation axis extending in an axial direction crossing the conveying direction and is rotatable about the first rotation axis. The first roller has a portion exposed to the conveying region. The separation member contacts the first roller in the conveying region at a contact position. The shutter has a second rotation axis extending in the axial direction and is rotatable about the second rotation axis. The second rotation axis is positioned downstream of the separation member in the conveying direction. The shutter is movable between a first position and a second position in accordance with its rotation about the second rotation axis. The shutter in the first position has a portion positioned within the conveying region and upstream of the contact position in the conveying direction. The shutter in the second position is retracted from the conveying region. The pressing portion is positioned upstream of the separation member and the shutter in the first position in the conveying direction. The pressing portion is linearly movable between a third position and a fourth position in a linear-moving direction crossing the conveying region. The pressing portion in the third position faces the first roller within the conveying region. The pressing portion in the fourth position is separated from the first roller farther than in the third position. The cam portion has a third rotation axis extending in the axial direction and is rotatable about the third rotation axis. The third rotation axis is positioned upstream of the pressing portion in the conveying direction. The cam portion is configured to contact the pressing portion to linearly move the pressing portion in the linear-moving direction. The cam portion is positioned upstream of the pressing portion in the conveying direction.

According to another aspect, the disclosure provides a sheet feeder including: a casing; a first roller; a shutter; a pressing portion; and a cam portion. The casing includes: a first casing having a first surface; and a second casing connected to the first casing and movable relative to the first casing between an open position and a closed position. The second casing has a second surface. The second surface faces the first surface with a gap between the first surface and the second surface when the second casing is at the closed position. The casing defines a conveying path between the first surface and the second surface when the second casing is at the closed position. The first roller has a portion protruding from the first surface. The first roller is configured to convey a medium in a conveying direction along the conveying path. The first roller has a roller rotation axis extending in an axial direction crossing the conveying direction and is rotatable about the roller rotation axis. The shutter is provided at the second casing. The shutter has a shutter rotation axis positioned downstream of the roller rotation axis in the conveying direction and extending parallel to the roller rotation axis. The shutter is rotatable about the shutter rotation axis. The shutter is movable between a first position and a second position in accordance with its rotation about the shutter rotation axis. The shutter in the first position has a portion positioned within the conveying path. The shutter in the second position is retracted from the conveying path. The pressing portion is provided at the second casing. The pressing portion is positioned upstream of the shutter in the first position in the conveying direction. The pressing portion is linearly movable between a third position and a fourth position in a direction crossing the conveying path. The pressing portion in the third position faces the first roller. The pressing portion in the fourth position is separated from the first roller farther than in the third position. The cam portion is provided at the second casing. The cam portion has a cam rotation axis extending parallel to the roller rotation axis and the shutter rotation axis. The cam portion is rotatable about the cam rotation axis. The cam rotation axis is positioned upstream of the pressing portion in the conveying direction. The cam portion is configured to contact the pressing portion to linearly move the pressing portion in the direction crossing the conveying path.

According to still another aspect, the disclosure provides a sheet feeder including: a first roller; a separation member; a shutter; a pressing portion; and a cam portion. The first roller is configured to convey a medium in a conveying direction. The separation member contacts the first roller at a contact position. The shutter has a first rotation axis positioned downstream of the separation member in the conveying direction and is rotatable about the first rotation axis. The shutter is movable between a first position and a second position in accordance with its rotation about the first rotation axis. The shutter in the first position has a portion positioned upstream of the contact position in the conveying direction. The shutter in the first position prohibits the medium from entering into the contact position. The shutter in the second position permits the medium to enter into the contact position. The pressing portion is positioned upstream of the separation member and the shutter in the first direction in the conveying direction. The pressing portion is linearly movable between a third position and a fourth position in a direction crossing the conveying path. The pressing portion in the third position faces the first roller. The pressing portion in the fourth position is separated from the first roller farther than in the third position. The cam portion has a second rotation axis extending parallel to the first rotation axis and is rotatable about the second rotation axis. The second rotation axis is positioned upstream of the pressing portion in the conveying direction. The cam portion is configured to contact the pressing portion to linearly move the pressing portion in the direction crossing the conveying path.

BRIEF DESCRIPTION OF THE DRAWINGS

The particular features and advantages of the embodiment as well as other objects will become apparent from the following description taken in connection with the accompanying drawings, in which.

DETAILED DESCRIPTION

Figure 1:
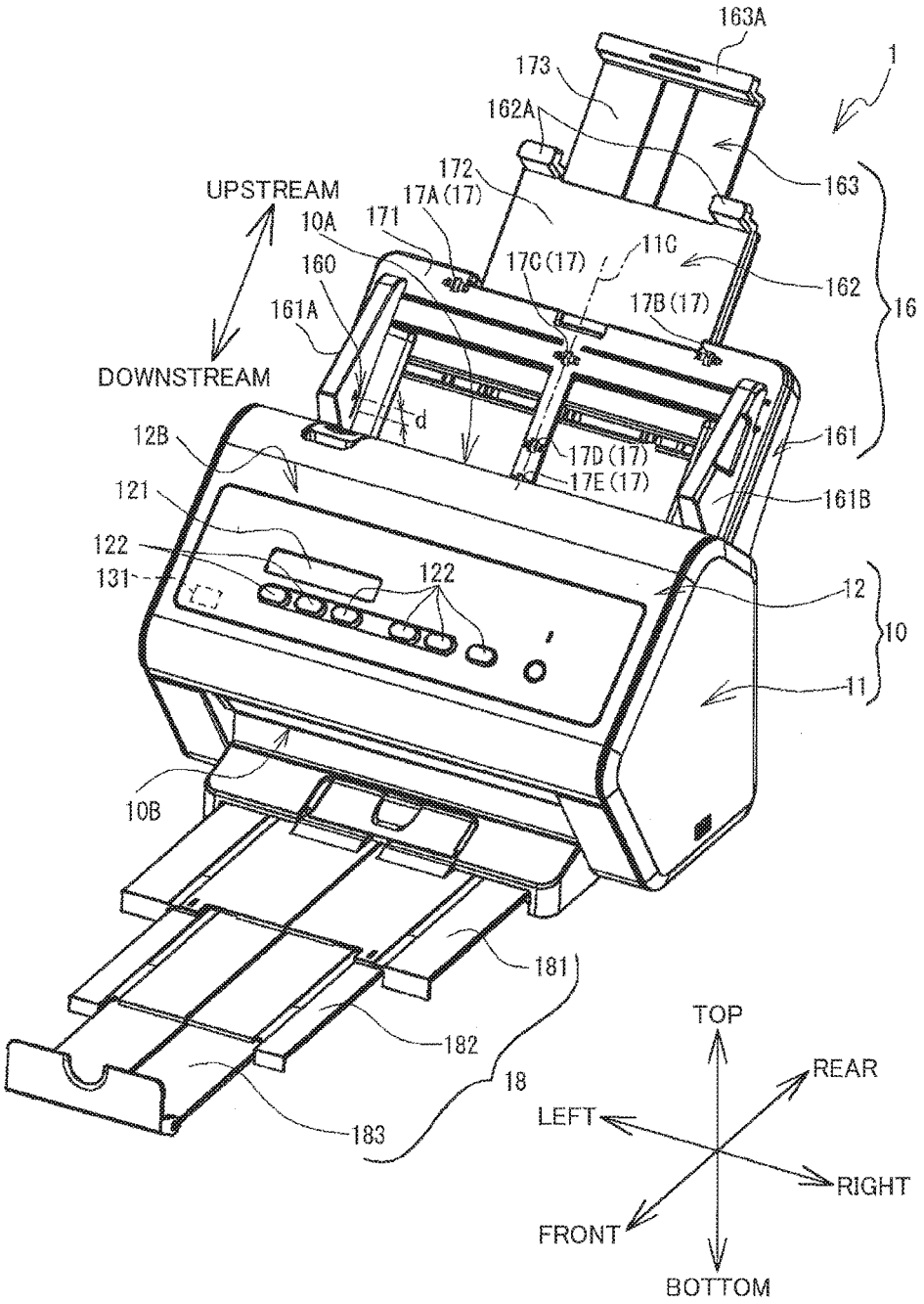
FIG. 1 is a perspective view of an image-reading apparatus 1 according to one embodiment of the disclosure in which a second casing 12 is at its closed position.

In the conventional sheet feeder described above, the flap exerts a force on the downstream edges of the plurality of sheets in a direction for impeding sheet conveyance as the plurality of sheets push the flap downstream. The force received from the flap may cause the downstream edges of the sheets to deform. Such deformation in the sheets increases the potential for the sheets to become damaged or for a paper jam to occur.

To avoid these problems, it is conceivable to configure the flap to be separate from the pick arm and to provide a separate vertical-motion mechanism for moving the flap up and down. However, in this case the vertical-motion mechanism must be provided between the second roller and the pick arm. Providing the vertical-motion mechanism between the second roller and the pick arm may cause a problem of increasing the overall size of the sheet feeder.

In view of the foregoing, it is an object of the disclosure to provide a sheet feeder capable of moving a third roller and a flap independently while suppressing (e.g., reducing) an increase in size.

An image-reading apparatus as an example of a sheet feeder according to one embodiment of the disclosure will be described with reference to the accompanying drawings, wherein like parts and components are designated by the same reference numerals to avoid duplicating description.

Figure 2:
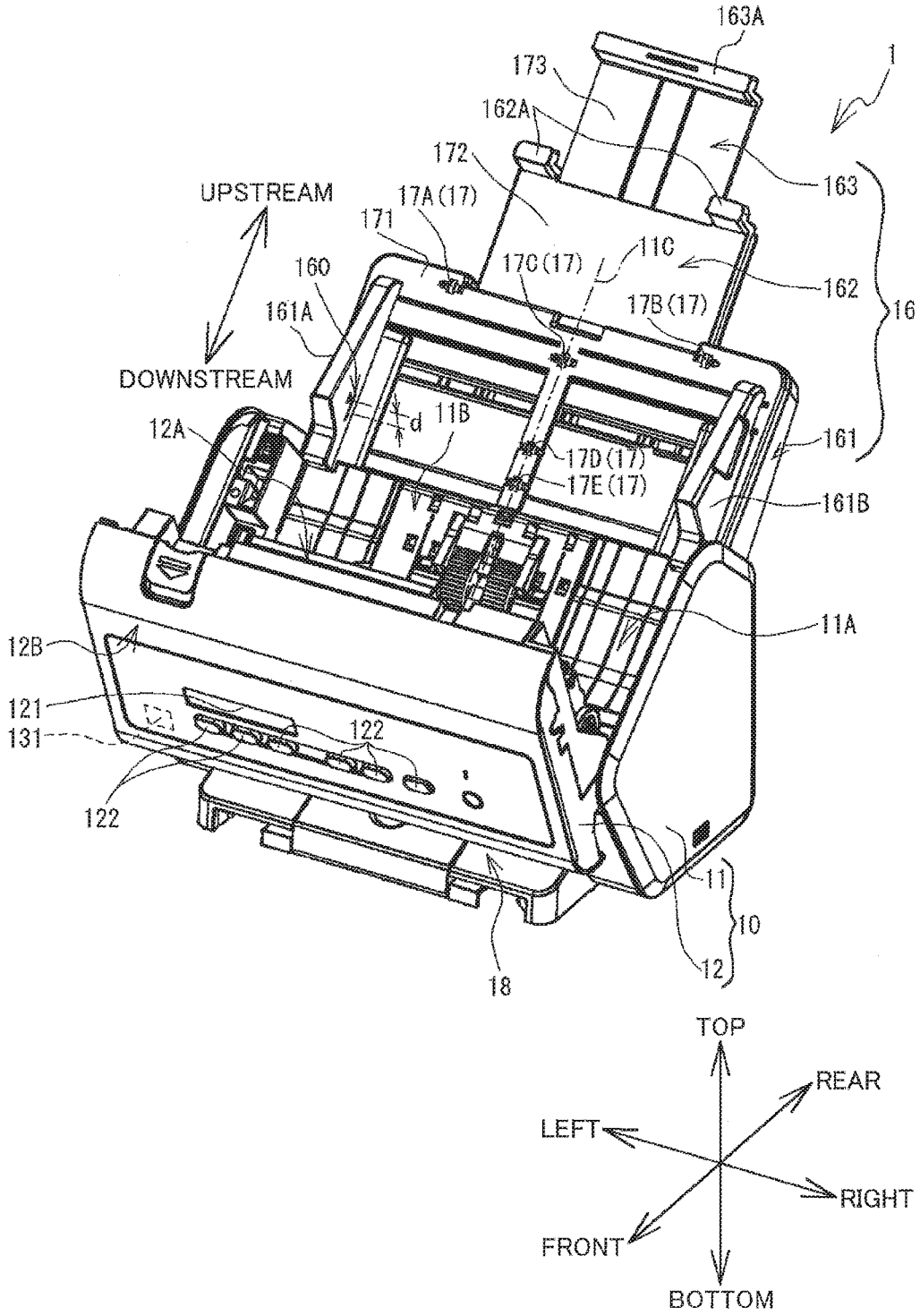
FIG. 2 is a perspective view of the image-reading apparatus 1 in which the second casing 12 is at its open position.
Figure 3:
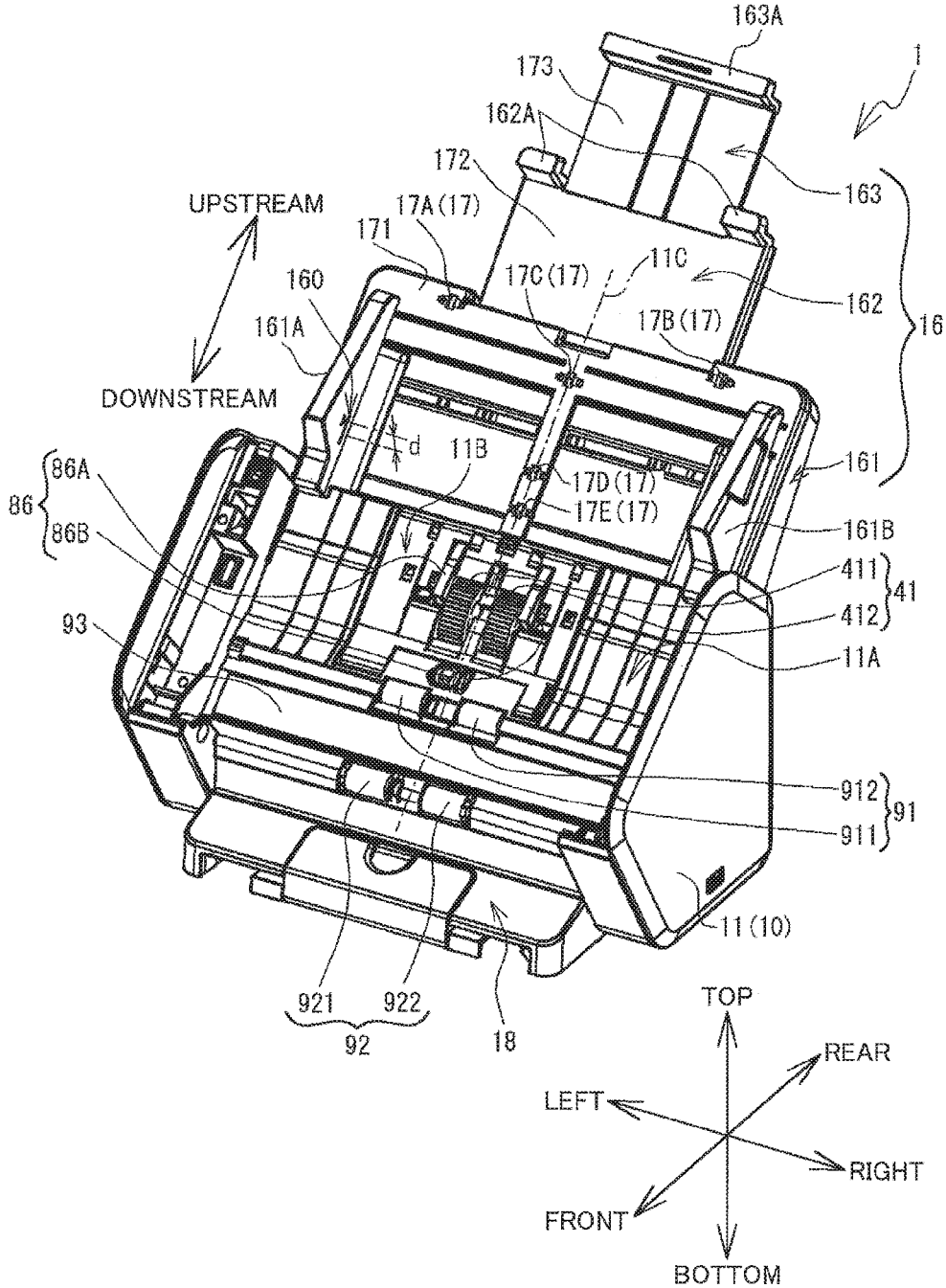
FIG. 3 is a perspective view of the image-reading apparatus 1 from which the second casing 12 has been removed.

As shown in FIGS. 1 through 3, an image-reading apparatus 1 includes a casing 10, a paper tray 16, and a discharge tray 18. In the following description, the top, bottom, upper-left, lower-right, lower-left, and upper-right sides of the image-reading apparatus 1 in FIG. 1 will be referred to respectively as the top, bottom, left, right, front, and rear sides of the image-reading apparatus 1.

<Casing 10, Paper Tray 16, and Discharge Tray 18>

As shown in FIGS. 1 and 2, the casing 10 has a first casing 11, and a second casing 12. Both the first casing 11 and the second casing 12 have a box-like shape. As shown in FIG. 2, the first casing 11 has a first surface 11A. The first surface 11A slopes downward from the rear side toward the front side. The first casing 11 has a support member 11B. The support member 11B forms left-right center and rear portions of the first surface 11A. The support member 11B is disposed around feed rollers 41 and a set guide 86 described later (see FIG. 17). The first casing 11 pivotally movably supports the second casing 12. A bottom end portion of the first surface 11A and a bottom end portion of the second casing 12 are movably connected to each other at left and right ends thereof. The second casing 12 can pivotally move about an imaginary line extending in a left-right direction along its bottom end portion.

Figure 5:
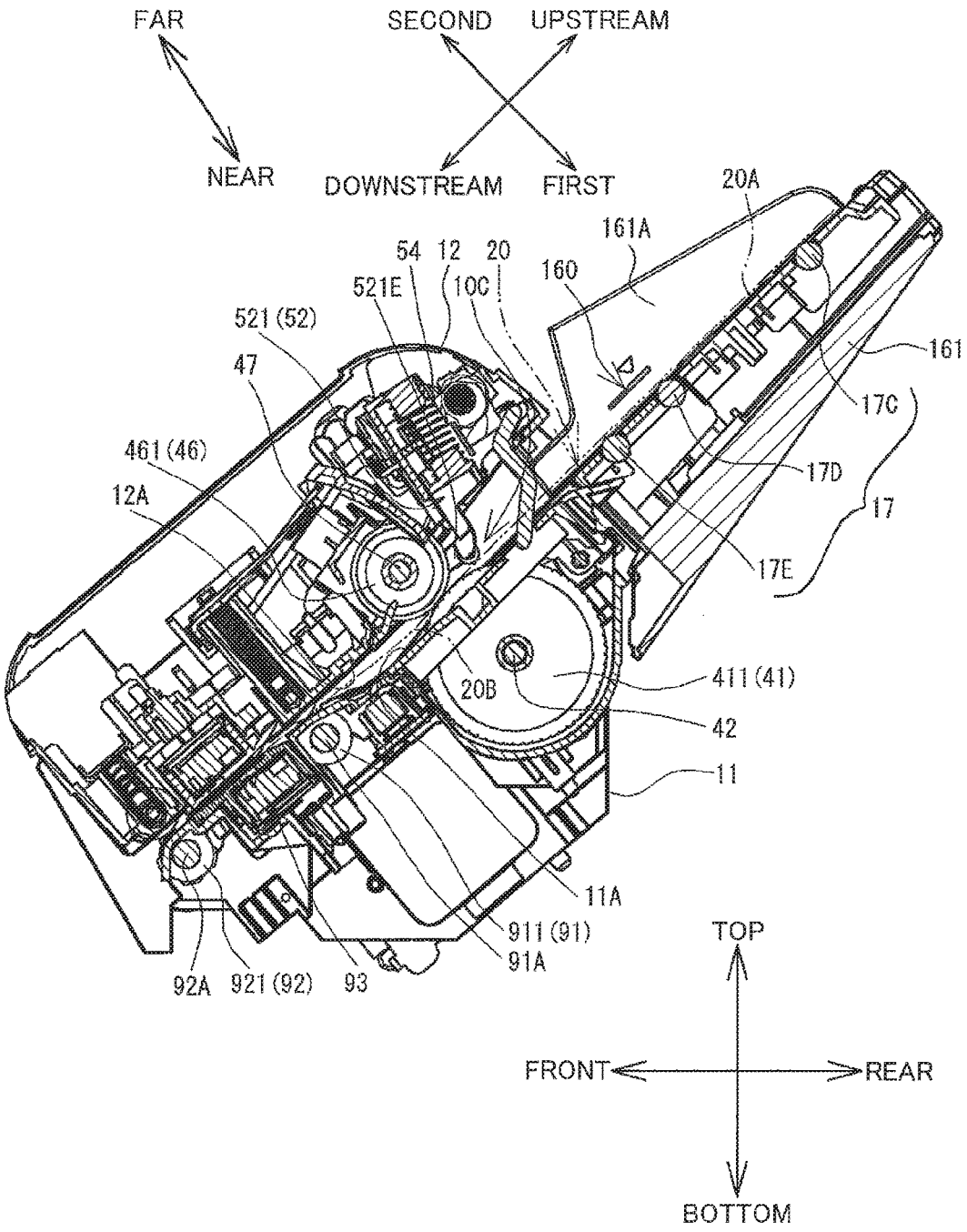
FIG. 5 is a cross-sectional view of the image-reading apparatus 1 taken along a center line 11C in FIG. 2 as viewed from a right side thereof.

A position of the second casing 12 relative to the first casing 11 shown in FIGS. 1 and 5 will be referred to as a "closed position" in the following description. In the closed position, a rear end of the second casing 12 is in its closest position to a rear end of the first casing 11. A position of the second casing 12 relative to the first casing 11 shown in FIG. 2 will be referred to as an "open position." An imaginary line extending along the first surface 11A and passing through the left-right center of the first surface 11A will be referred to as a "centerline 11C." Unless otherwise specified, clockwise and counterclockwise directions will indicate rotational directions from a right side perspective.

As shown in FIGS. 1 and 2, the second casing 12 has a top surface 12B forming an upper surface of the casing 10. A display section 121 and an operating section 122 are provided on the top surface 12B. The display section 121 is a liquid crystal display capable of displaying the status of the image-reading apparatus 1. The operating section 122 includes a plurality of push buttons enabling a user to input instructions into the image-reading apparatus 1. The display section 121 and the operating section 122 are electrically connected to a control section 131. The control section 131 is disposed in the second casing 12 at a position on a bottom side of the top surface 12B. The control section 131 includes a CPU that controls the image-reading apparatus 1. Note that the control section 131 may be provided in the first casing 11.

As shown in FIG. 2, the second casing 12 also has a second surface 12A on an opposite side of the second casing 12 from the top surface 12B. When the second casing 12 is in the closed position, as shown in FIG. 1, the second surface 12A confronts the first surface 11A of the first casing 11. When the second casing 12 is in the closed position, the first surface 11A and the second surface 12A are separated by a prescribed gap. On the other hand, when the second casing 12 is in the open position shown in FIG. 2, a rear end of the first surface 11A and a rear end of the second surface 12A are separated by more than the prescribed gap.

As shown in FIG. 1, a feed opening 10A is defined as an area between a top edge of the first surface 11A and a top edge of the second surface 12A (see FIG. 2) when the second casing 12 is in the closed position. A discharge opening 10B is defined as an area between a bottom edge of the first surface 11A and a bottom edge of the second surface 12A when the second casing 12 is in the closed position. A conveying region 10C (see FIG. 5) is defined as an area between the first surface 11A and the second surface 12A. The conveying region 10C communicates with the exterior of the casing 10 through the feed opening 10A and the discharge opening 10B.

As shown in FIGS. 1 through 3, the paper tray 16 has a first sheet-feeding tray 161, a second sheet-feeding tray 162, and a third sheet-feeding tray 163. The first through third sheet-feeding trays 161-163 all have a plate-like shape. The first sheet-feeding tray 161 extends diagonally upward and rearward from a portion of the first casing 11 to the rear of the feed opening 10A. A left-right dimension of the first sheet-feeding tray 161 is approximately equal to a left-right dimension of the first casing 11. Hereinafter, a top surface of the first sheet-feeding tray 161 will be referred to as a tray surface 171.

The first sheet-feeding tray 161 has contact members 17A, 17B, 17C, 17D, and 17E. The contact members 17A-17E are columnar-shaped rollers. Hereinafter, the contact members 17A-17E will also be collectively referred to as contact members 17. Portions of the contact members 17 protrude upward from the tray surface 171. More specifically, upper edges of the contact members 17 (i.e. upper portions of outer circumferential surfaces thereof) are positioned higher than the tray surface 171. The contact member 17A is provided to the left of the centerline 11C and at an upstream end portion (i.e., a top end portion) of the first sheet-feeding tray 161 in a conveying direction described later. The contact member 17B is provided to the right of the centerline 11C and at the upstream end portion (i.e. the top end portion) of the first sheet-feeding tray 161 in the conveying direction. The contact members 17C-17E are disposed at positions overlapping the centerline 11C. The contact members 17C, 17D, and 17E are juxtaposed in order from the top toward the bottom.

The contact members 17 are capable of rotating about respective shaft members extending in the left-right direction. When a sheet resting on the first sheet-feeding tray 161 is conveyed, a frictional force generated between the contact members 17 and the sheet causes the contact members 17 to rotate counterclockwise. In this way, the contact members 17 reduce a force of resistance to a sheet being conveyed into the conveying region 10C through the feed opening 10A. Portions of the contact members 17 that protrude farthest from the tray surface 171 (hereinafter referred to as "tops" of the contact members 17) verge on an imaginary plane surface 20A (see FIG. 5), which is a specific imaginary plane. In other words, the tops of the contact members 17 define part of the imaginary plane surface 20A. Sheets resting on the first sheet-feeding tray 161 are conveyed along the imaginary plane surface 20A. As will be described later in detail, the imaginary plane surface 20A is continuous with an imaginary surface 20B within the conveying region 10C (see FIGS. 5 and 6). The imaginary plane surface 20A and the imaginary surface 20B together form a conveying path 20 (see FIG. 5). Thus, the imaginary plane surface 20A corresponds to part of the conveying path 20.

The first sheet-feeding tray 161 is provided with a guide 161A and a guide 161B. The guide 161A is disposed at a left end portion of the tray surface 171. The guide 161B is disposed at a right end portion of the tray surface 171. The guides 161A and 161B are plate-shaped members that protrude upward from the tray surface 171. Side surfaces of the guides 161A and 161B face in left and right directions. The guides 161A and 161B can move over the tray surface 171 in the left and right directions. The guides 161A and 161B center the position of sheets placed in the first sheet-feeding tray 161 relative to the left-right direction. The guides 161A and 161B are configured to move in association with each other in the left and right directions through a rack and pinion mechanism provided inside the first sheet-feeding tray 161, for example.

A height identifying portion 160 is formed in a right surface of the guide 161A. The height identifying portion 160 is a linear recess formed above the conveying path 20 and extending parallel to the conveying path 20 (see FIG. 5). The height identifying portion 160 is recessed leftward into the right surface of the guide 161A. The height identifying portion 160 is separated from the conveying path 20 by a distance d in a direction orthogonal to the conveying path 20. In the embodiment, the distance d is 5 mm. The distance d identified by the height identifying portion 160 denotes the maximum thickness of sheets that the image-reading apparatus 1 allows to be stacked on the paper tray 16.

The second sheet-feeding tray 162 extends diagonally upward and rearward from a top end portion of the first sheet-feeding tray 161. The second sheet-feeding tray 162 can move in diagonal directions toward the upper-rear and the lower-front that are parallel to the tray surface 171. Hereinafter, a top surface of the second sheet-feeding tray 162 will be referred to as a tray surface 172. The third sheet-feeding tray 163 extends diagonally upward and rearward from a top end portion of the second sheet-feeding tray 162. The third sheet-feeding tray 163 can move in diagonal directions toward the upper-rear and the lower-front that are parallel to the tray surfaces 171 and 172. Hereinafter, a top surface of the third sheet-feeding tray 163 will be referred to as a tray surface 173.

Guides 162A are provided at a top edge of the second sheet-feeding tray 162 with one on either left and right side of the third sheet-feeding tray 163. The guides 162A extend diagonally upward and forward from the tray surface 172. A guide 163A is provided at a top edge of the third sheet-feeding tray 163. The guide 163A extends diagonally upward and forward from the tray surface 173. The positions of the guides 162A and 163A can be adjusted by moving the second and third sheet-feeding trays 162 and 163 to match the size of the sheets placed in the paper tray 16.

As shown in FIG. 1, the discharge tray 18 has a first discharge tray 181, a second discharge tray 182, and a third discharge tray 183. The first through third discharge trays 181-183 all have a plate-like shape. The first discharge tray 181 extends forward from a portion of the first casing 11 below the discharge opening 10B. The second discharge tray 182 extends forward from a front end portion of the first discharge tray 181. The third discharge tray 183 extends forward from a front end portion of the second discharge tray 182. The first through third discharge trays 181-183 can move in front and rear directions. In FIG. 2, the first through third discharge trays 181-183 of the discharge tray 18 have all been moved to their rear positions.

<Feed Roller 41 and Conveying Rollers 91 and 92>

As shown in FIG. 3, feed rollers 411 and 412 (hereinafter also collectively referred to as feed rollers 41), conveying rollers 911 and 912 (hereinafter also collectively referred to as conveying rollers 91), and conveying rollers 921 and 922 (hereinafter also collectively referred to as conveying rollers 92) are provided in the first casing 11. The feed rollers 41, the conveying rollers 91, and the conveying rollers 92 are arranged along the first surface 11A in order from the upper-rear to the lower-front. The feed roller 411 and the conveying rollers 911 and 921 are arranged to the left of the centerline 11C, while the feed roller 412 and the conveying rollers 912 and 922 are arranged to the right of the centerline 11C.

Figure 4:
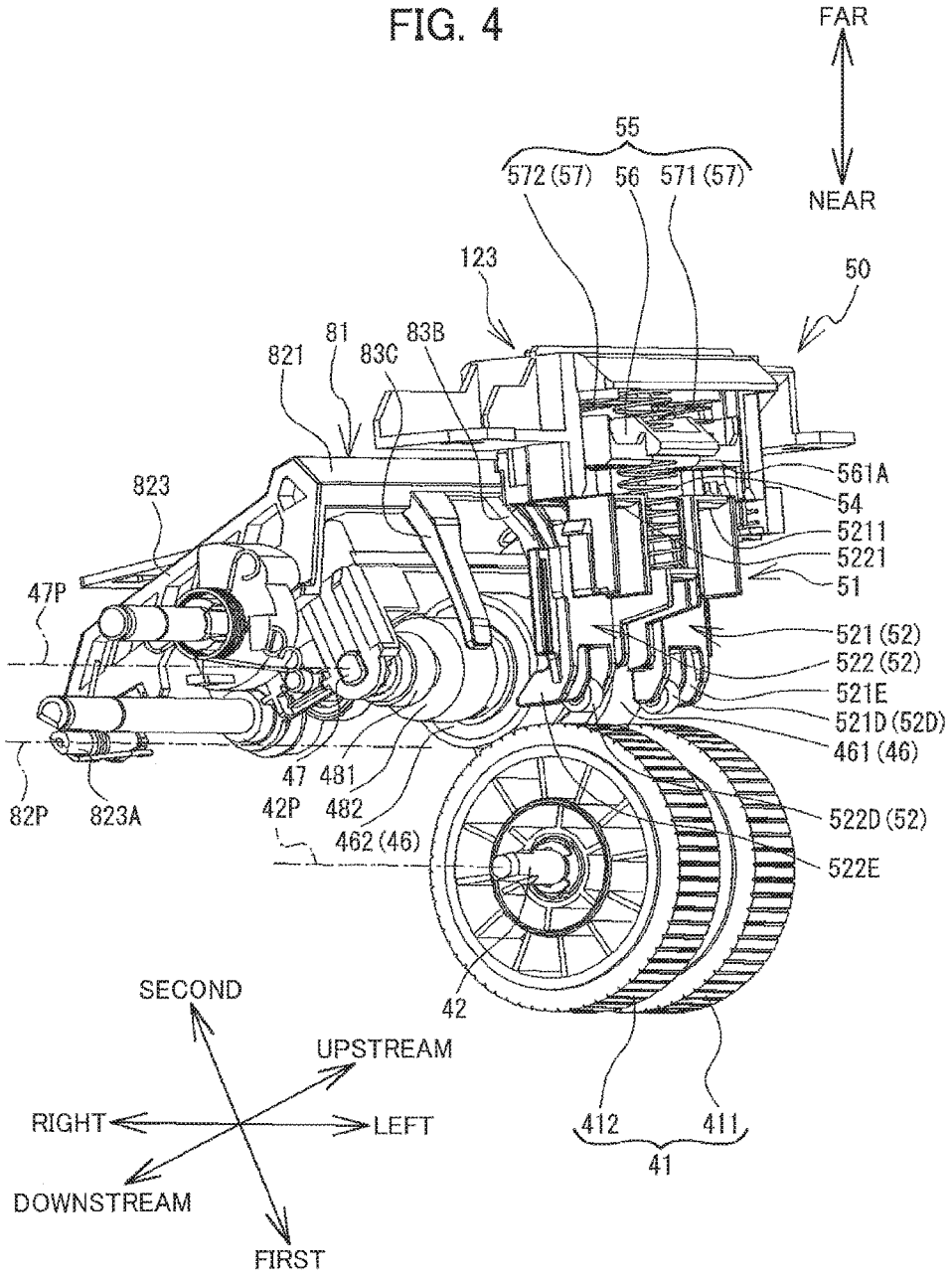
FIG. 4 is a perspective view of feed rollers 41, reverse rollers 46, and a pressing mechanism 50.

As shown in FIG. 4, the feed rollers 41 are columnar in shape. The feed rollers 41 have an axis oriented in the left-right direction. The feed rollers 411 and 412 have the same shape. As shown in FIG. 3, a distance in the left-right direction from the centerline 11C to an end face of the feed roller 411 on the centerline 11C side is equivalent to a distance in the left-right direction from the centerline 11C to an end face of the feed roller 412 on the centerline 11C side. A plurality of linear grooves extending in the left-right direction is formed on an outer circumferential surface of each feed roller 41. As shown in FIG. 4, a shaft member 42 extends along the axis of the feed rollers 41. The shaft member 42 is rotatably supported in the first casing 11 (see FIG. 3). The shaft member 42 rotates in response to rotation of a first motor 71 described later (see FIG. 24). Hereinafter, an imaginary straight line extending in the left-right direction and passing through the center of the shaft member 42 will be referred to as an imaginary line 42P. The feed rollers 41 rotate about the imaginary line 42P in response to the rotation of the shaft member 42. As shown in FIG. 5, portions of the feed rollers 41 (for example, top portions of the outer circumferential surfaces of the feed rollers 41) protrude above the first surface 11A of the first casing 11 into the conveying region 10C.

As shown in FIG. 3, the conveying rollers 91 and 92 are columnar in shape. The conveying rollers 91 have an axis oriented in the left-right direction. The conveying rollers 92 have an axis oriented in the left-right direction. The conveying rollers 911, 912, 921, and 922 all have the same shape. A distance in the left-right direction from the centerline 11C to end faces of the conveying rollers 911 and 921 on the centerline 11C side is equivalent to a distance in the left-right direction from the centerline 11C to end faces of the conveying rollers 912 and 922 on the centerline 11C side. As shown in FIG. 5, a shaft member 91A extends along the axis of the conveying rollers 91, and a shaft member 92A extends along the axis of the conveying rollers 92. The shaft members 91A and 92A are rotatably supported in the first casing 11. The shaft members 91A and 92A rotate in response to rotation of a second motor 72 described later (see FIG. 24). The conveying rollers 91 rotate in response to the rotation of the shaft member 91A, and the conveying rollers 92 rotate in response to the rotation of the shaft member 92A. Portions of the conveying rollers 91 and 92 (for example, top portions of outer circumferential surfaces of the conveying rollers 91 and 92) protrude above the first surface 11A of the first casing 11 into the conveying region 10C.

<Conveying Path 20>

Figure 6:
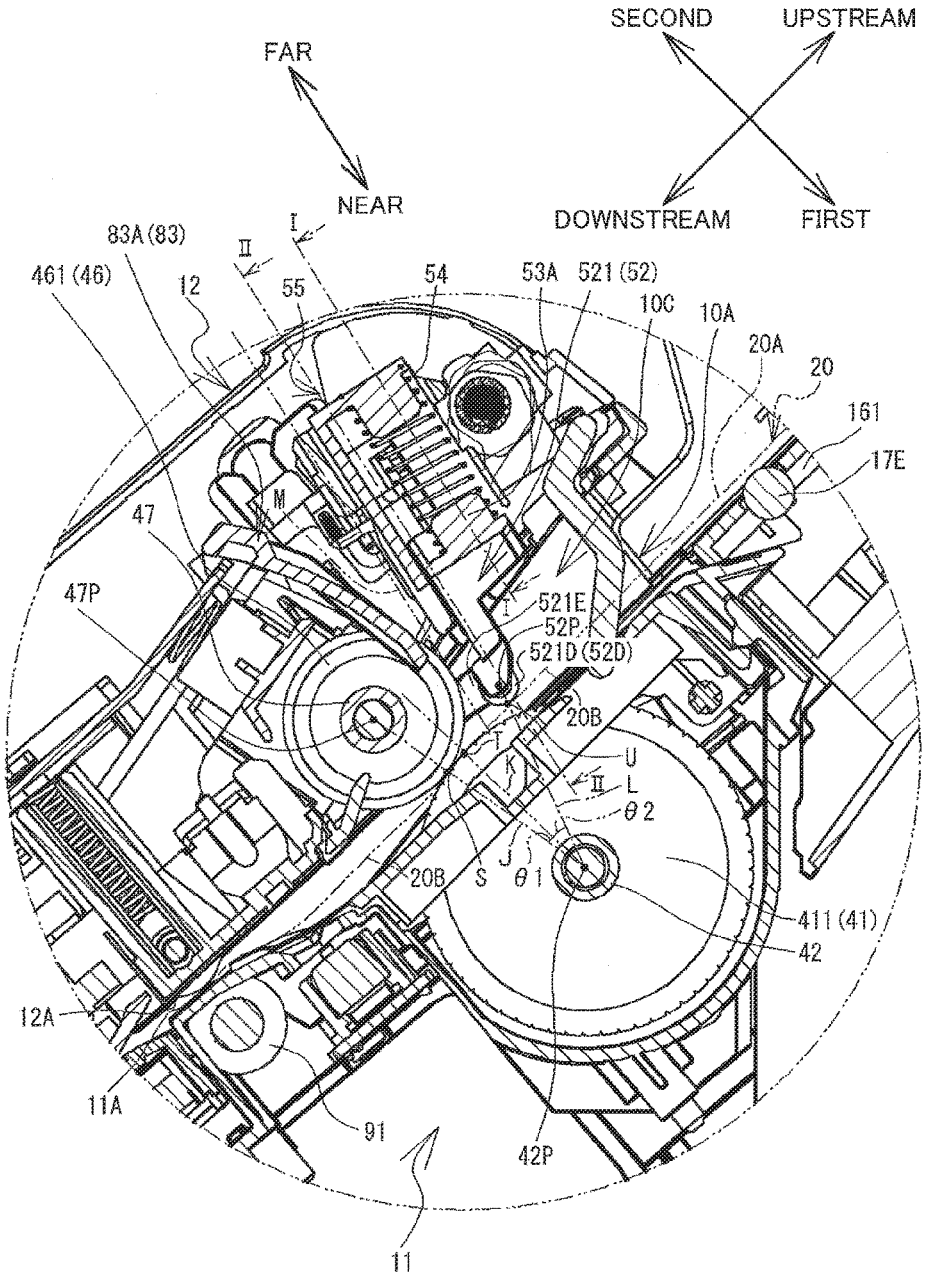
FIG. 6 is a partial enlarged view of the cross-sectional view in FIG. 5.

The imaginary surface 20B is a surface within the conveying region 10C, i.e., a specific imaginary surface that includes portions of the feed rollers 41 and portions of the conveying rollers 91 and 92 protruding farthest from the first surface 11A (i.e., portions positioned above the first surface 11A and at a distance farthest from the first surface 11A; hereinafter referred to as "tops" of the feed rollers 41 and "tops" of the conveying rollers 91 and 92). As shown in FIG. 6, the imaginary surface 20B extends in a planar shape on the feed opening 10A side from the feed rollers 41 and curves on the discharge opening 10B side from the feed rollers 41. The planar portion of the imaginary surface 20B on the feed opening 10A side from the feed rollers 41 extends along the imaginary plane surface 20A defined by the contact members 17 of the paper tray 16 (see FIGS. 1 through 3). That is, the planar portion of the imaginary surface 20B on the feed opening 10A side from the feed rollers 41 defines a common plane to the imaginary plane surface 20A. The curved portion of the imaginary surface 20B on the discharge opening 10B side from the feed rollers 41 follows the tops of the feed rollers 41 and the tops of the conveying rollers 91 and 92. A surface that contains the imaginary plane surface 20A and the imaginary surface 20B is referred to as the conveying path 20. The conveying path 20 corresponds to a surface along which a sheet passes when the image-reading apparatus 1 performs a reading process to take in a sheet and read an image on the surface of the sheet.

A direction along the conveying path 20 and orthogonal to the left-right direction will be referred to as the conveying direction. The conveying direction corresponds to a direction extending from the upper-rear to the lower-front. The feed opening 10A side relative to the conveying region 10C in the conveying direction will be referred to as an upstream side, while the discharge opening 10B side relative to the conveying region 10C in the conveying direction will be referred to as a downstream side. A direction orthogonal to the conveying path 20 will be referred to as an orthogonal direction. The orthogonal direction corresponds to a direction connecting the upper-front and the lower-rear. A side in the orthogonal direction of the conveying path 20 on which the first surface 11A is disposed will be referred to as a first side. The first side corresponds to the lower-rear side relative to the conveying path 20. A side in the orthogonal direction of the conveying path 20 on which the second surface 12A is disposed will be referred to as a second side. The second side corresponds to the upper-front side relative to the conveying path 20. The feed rollers 41 and the conveying rollers 91 and 92 are disposed on the first side relative to the conveying path 20.

<Image-Reading Section 93>

As shown in FIG. 3, an image-reading section 93 is a contact-type image sensor (CIS) well known in the art. The image-reading section 93 is provided on the first surface 11A of the first casing 11 at a position between the conveying rollers 91 and 92 in the conveying direction. The image-reading section 93 is electrically connected to the control section 131 (see FIG. 1). A dimension in the left-right direction of the image-reading section 93 is approximately equal to a dimension in the left-right direction of the first surface 11A. The image-reading section 93 reads an image from a surface on the first side of a sheet as the sheet is conveyed along the conveying path 20 from the upstream side toward the downstream side. The image-reading section 93 outputs data for the read image to the control section 131.

<Reverse Roller 46>

Reverse rollers 461 and 462 are provided at the second casing 12. As shown in FIG. 4, the reverse roller 461 is provided on the second side relative to the feed roller 411, and the reverse roller 462 is provided on the second side relative to the feed roller 412. The reverse rollers 461 and 462 have the same shape. Hereinafter, the reverse rollers 461 and 462 will also be collectively referred to as reverse rollers 46. The reverse rollers 46 have a columnar shape with a diameter smaller than that of the feed rollers 41. Dimensions in the left-right direction of the reverse rollers 461 and 462 are approximately equal to dimensions in the left-right direction of the feed rollers 411 and 412. The center in the left-right direction of the reverse roller 461 is aligned with (i.e. coincident with) the center in the left-right direction of the feed roller 411 in the left-right direction, and the center in the left-right direction of the reverse roller 462 is aligned with (i.e. coincident with) the center in the left-right direction of the feed roller 412 in the left-right direction. The reverse rollers 461 and 462 are separated in the left-right direction.

The reverse rollers 46 have an axis oriented in the left-right direction. A shaft member 47 extends along the axis of the reverse rollers 46. The shaft member 47 is rotatably supported in the second casing 12 (see FIGS. 1 and 2). The reverse rollers 46 are connected to the shaft member 47 through a torque limiter 482. A gear 481 is connected to a right end portion of the shaft member 47. The shaft member 47 rotates in response to the rotation of the second motor 72 described later (see FIG. 24). Hereinafter, an imaginary straight line extending in the left-right direction and passing through the center of the shaft member 47 will be referred to as an imaginary line 47P. The reverse rollers 46 rotate about the imaginary line 47P in response to the rotation of the shaft member 47. As shown in FIG. 6, portions of the reverse rollers 46 protrude downward through the second surface 12A into the conveying region 10C. A portion of an outer circumferential surface of the reverse roller 461 nearest the feed roller 411 contacts the feed roller 411 within the conveying region 10C. Similarly, a portion of an outer circumferential surface of the reverse roller 462 nearest the feed roller 412 contacts the feed roller 412 within the conveying region 10C. The reverse rollers 46 are disposed on the second side relative to the conveying path 20.

Hereinafter, as shown in FIG. 6, an imaginary plane orthogonal to the conveying path 20 and passing through the imaginary line 42P will be referred to as a reference plane K. A point of each feed roller 41 that verges on the conveying path 20 will be referred to as a contact point T. The contact point T is provided on the reference plane K. The imaginary line 47P is disposed downstream of the imaginary line 42P in the conveying direction. Accordingly, the imaginary line 47P is disposed downstream of the reference plane K in the conveying direction. An imaginary plane passing through the imaginary lines 42P and 47P will be referred to as an imaginary plane J. A point of contact between each reverse roller 46 and the corresponding feed roller 41 will be referred to as a contact point S. The contact point S is provided on the imaginary plane J and downstream of the reference plane K in the conveying direction. An acute angle formed by the reference plane K and the imaginary plane J will be referred to as an angle θ1. The angle θ1 is 10° in the embodiment.

<Pressing Mechanism 50>

Figure 7:
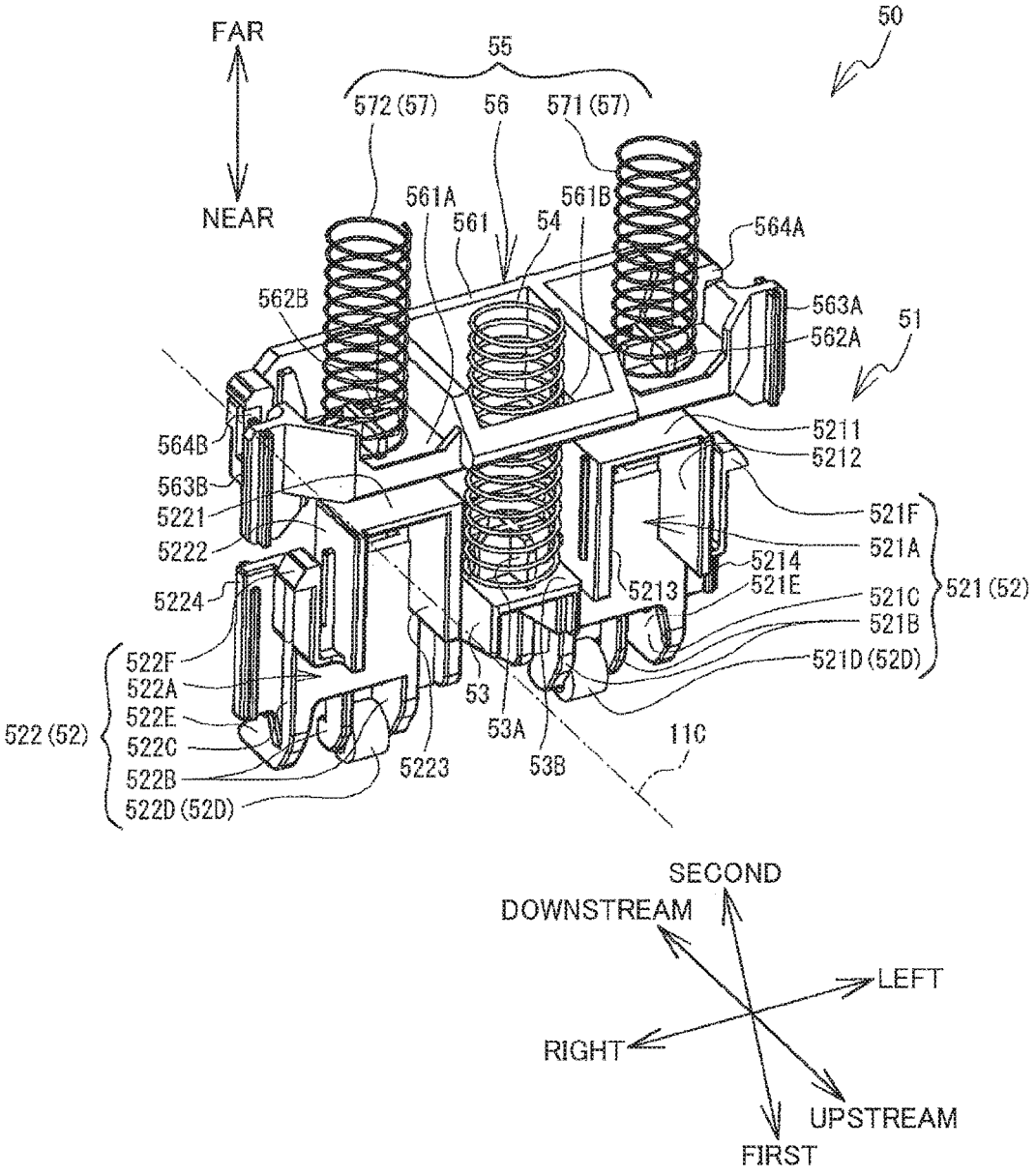
FIG. 7 is a perspective view of the pressing mechanism 50.

A pressing mechanism 50 is provided at the second casing 12. As shown in FIG. 4, the pressing mechanism 50 is disposed upstream of the reverse rollers 46 in the conveying direction and on the second side relative to the conveying path 20. As shown in FIG. 7, the pressing mechanism 50 includes a pressing portion 51, a first spring 54, and an urging portion 55. The pressing portion 51 confronts the feed rollers 41, with the conveying path 20 interposed between the pressing portion 51 and the feed rollers 41. The first spring 54 and the urging portion 55 are disposed on the side of the pressing portion 51 opposite the side nearest the feed rollers 41. The pressing mechanism 50 is supported by a support member 123 (see FIGS. 8 through 11) fixedly provided in the second casing 12. The support member 123 will be described later in detail.

As shown in FIG. 7, the pressing portion 51 has protruding members 521 and 522, and a bridging member 53. The protruding members 521 and 522 are juxtaposed in the left-right direction. The protruding member 521 is disposed on the left side relative to the centerline 11C in the left-right direction, while the protruding member 522 is disposed on the right side relative to the centerline 11C in the left-right direction. The shapes of the protruding members 521 and 522 have left-right symmetry. Hereinafter, the protruding members 521 and 522 will also be collectively referred to as protruding members 52. As shown in FIG. 6, the protruding members 52 extend diagonally from the upstream and second side toward the downstream and first side. The protruding member 52 slopes slightly relative to the orthogonal direction. Next, the protruding member 521 will be described in detail, while a description of the protruding member 522 will be simplified.

As shown in FIG. 7, the protruding member 521 has a base part 521A, two first support parts 521B, a second support part 521C, a pressure roller 521D, a restricting part 521E, and a stopper 521F. Note that in the description of the protruding members 52, directions of linear motion of the protruding members 52 are defined separately from the orthogonal direction to the conveying direction. The directions of linear motion correspond to a direction extending along the protruding member 52. In these directions of linear motion, the side relative to the protruding members 52 near the feed rollers 41 will be referred to as a near side, while the side opposite the near side will be referred to as a far side.

The base part 521A has plate-shaped parts 5211, 5212, 5213, and 5214. The plate-shaped parts 5211, 5212, and 5213 respectively form surfaces on the far side, left side, and right side parts of the protruding member 521. The plate-shaped part 5214 extends in the directions of linear motion and protrudes leftward further than the plate-shaped part 5212.

The two first support parts 521B and the second support part 521C are all plate shaped and protrude from a near-side end of the base part 521A toward the near side. Surfaces of the two first support parts 521B and the second support part 521C face in the left and right directions. The two first support parts 521B and the second support part 521C are juxtaposed in order from right to left and are spaced at substantially regular intervals in the left-right direction.

Figure 9:
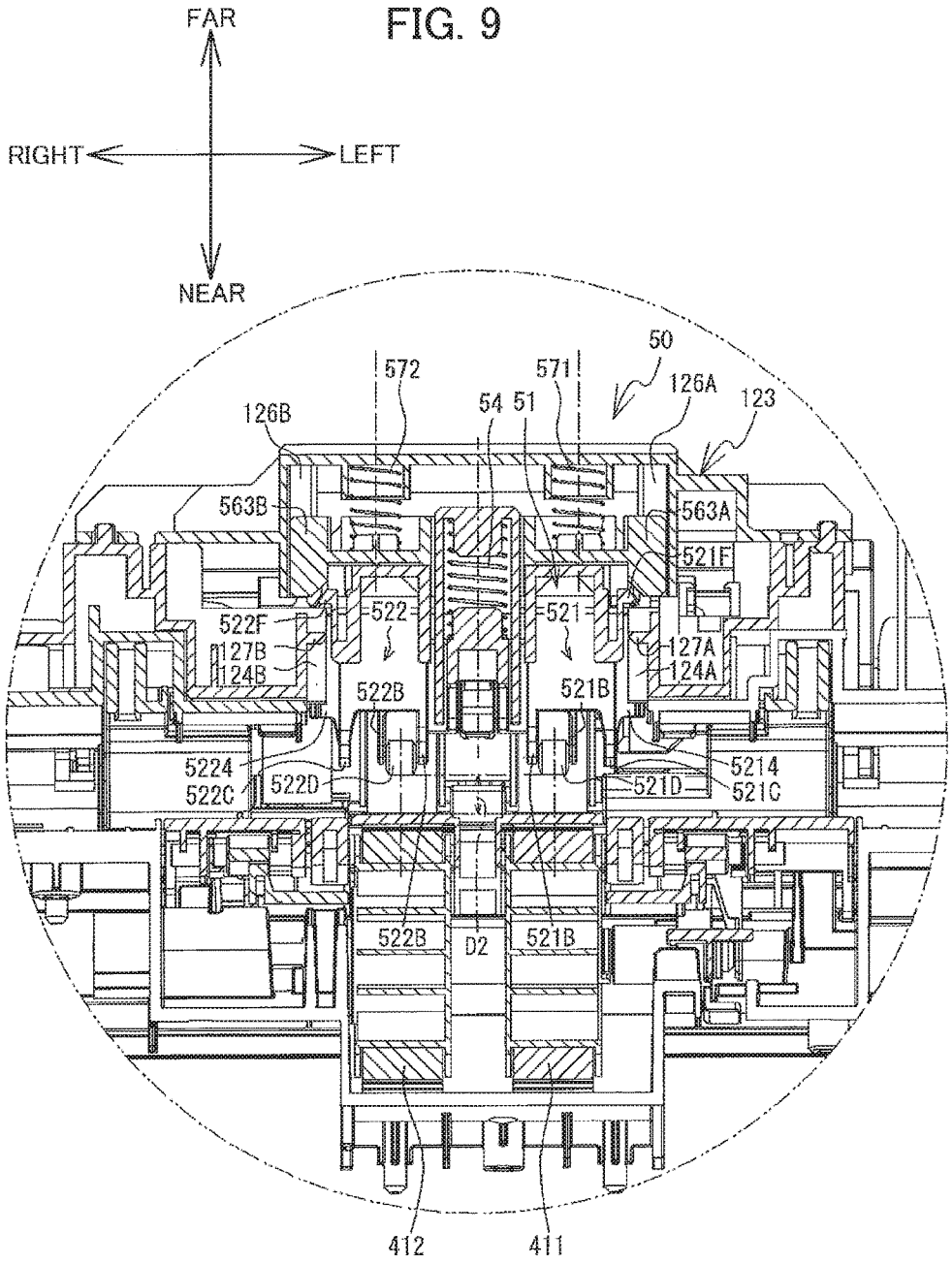
FIG. 9 is a cross-sectional view taken along the line I-I in FIG. 6 as viewed in the direction indicated by arrows, in which the pressing portion 51 is in its third position.
Figure 11:
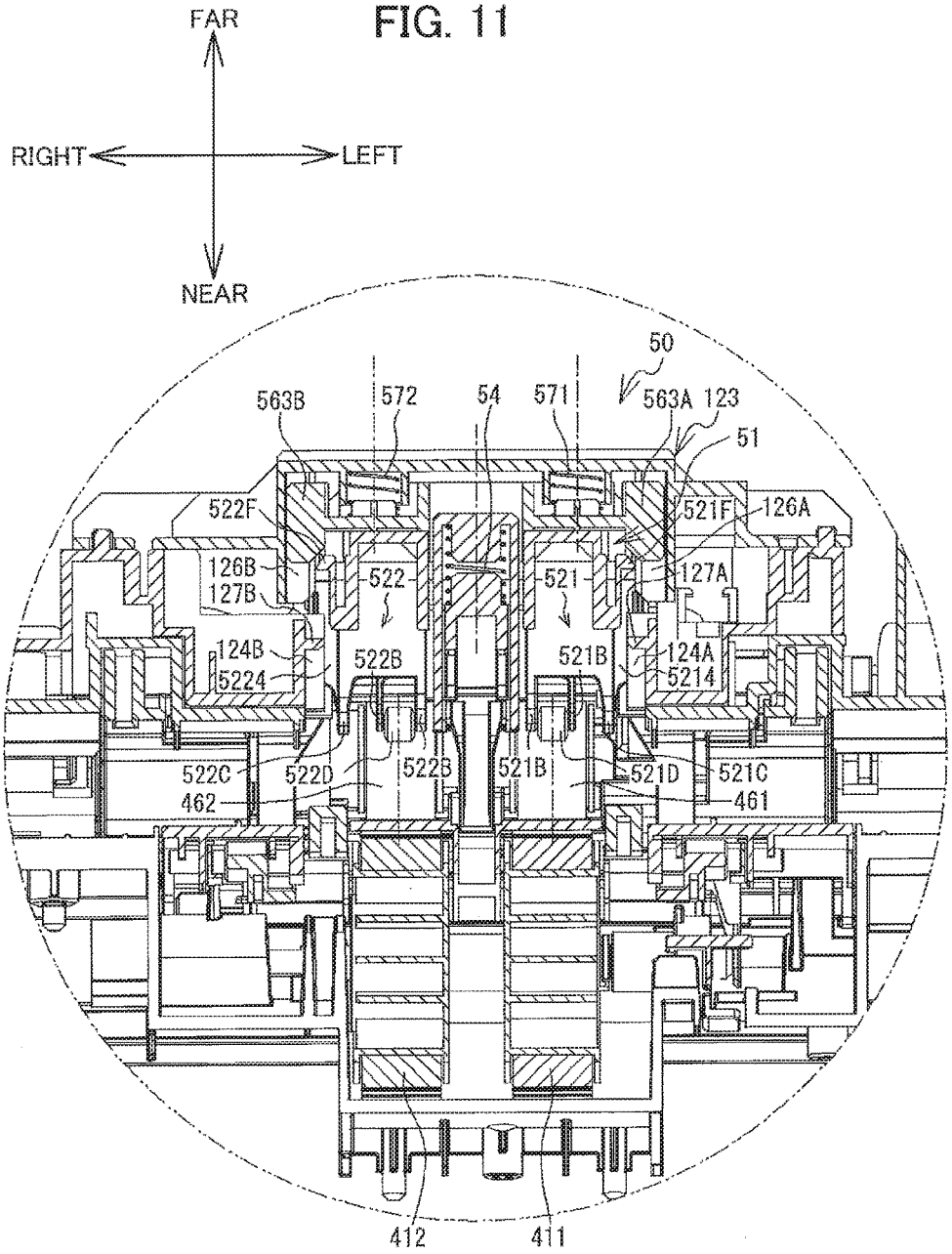
FIG. 11 is a cross-sectional view taken along the line I-I in FIG. 6 as viewed in the direction indicated by arrows, in which the pressing portion 51 is in its second position.

As shown in FIGS. 9 and 11, the two first support parts 521B are disposed leftward from a right end face of the feed roller 411 and a right end face of the reverse roller 461 in the left-right direction, and also disposed rightward from a left end face of the feed roller 411 and a left end face of the reverse roller 461 in the left-right direction. The second support part 521C is disposed leftward from the left end face of the feed roller 411 and the left end face of the reverse roller 461 in the left-right direction.

As shown in FIG. 7, the pressure roller 521D has a columnar shape. The pressure roller 521D has an axis oriented in the left-right direction. The pressure roller 521D is rotatably supported by the two first support parts 521B at a position between the two first support parts 521B. A near-side edge (i.e. a near-side portion of an outer circumferential surface) of the pressure roller 521D protrudes further toward the near side than near-side edges of the first support parts 521B. The near-side edge of the pressure roller 521D is a portion of the protruding member 521 that protrudes furthest on the near side. Thus, the near-side edge of the pressure roller 521D is the portion of the protruding member 521 closest to the feed roller 411.

Figure 8:
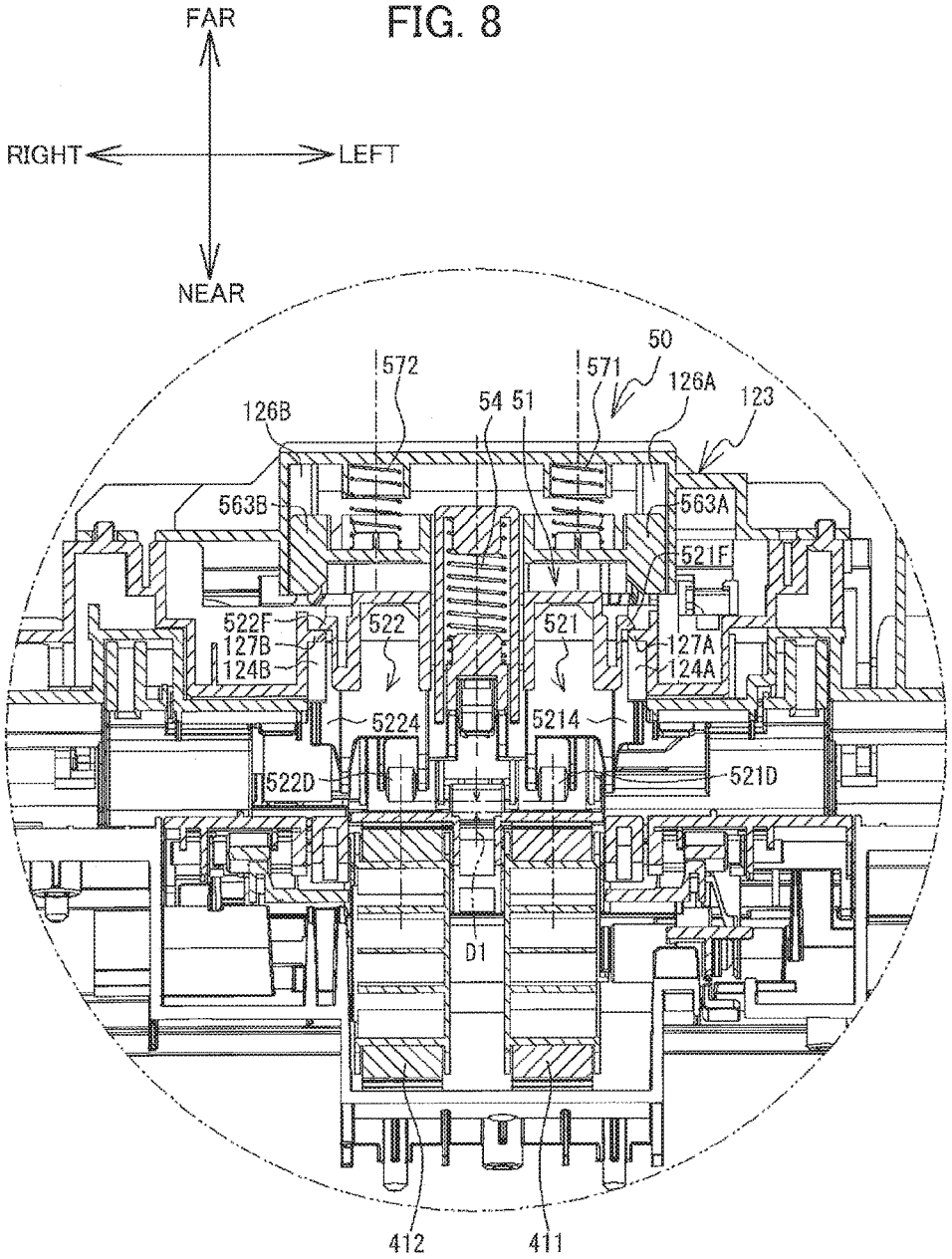
FIG. 8 is a cross-sectional view taken along a line I-I in FIG. 6 as viewed in a direction indicated by arrows, in which a pressing portion 51 is in its first position.

As shown in FIGS. 8, 9, and 11, a dimension in the left-right direction of the pressure roller 521D is shorter than the dimension in the left-right direction of the feed roller 411. The center in the left-right direction of the pressure roller 521D is aligned with (i.e. coincident with) the center in the left-right direction of the feed roller 411 in the left-right direction. A right end face of the pressure roller 521D is positioned to the left of the right end face of the feed roller 411 in the left-right direction. A left end face of the pressure roller 521D is positioned to the right of the left end face of the feed roller 411 in the left-right direction.

As shown in FIG. 7, the restricting part 521E has a plate shape. The restricting part 521E extends downstream from a near-side end of the second support part 521C in the conveying direction. As shown in FIGS. 8, 9, and 11, a near-side end of the restricting part 521E is closer to the far side than the near-side edge of the pressure roller 521D. As shown in FIG. 6, a downstream end of the restricting part 521E is positioned further downstream than an upstream edge (i.e. an upstream portion of the outer circumferential surface) of the reverse roller 461 in the conveying direction. The downstream end of the restricting part 521E is also disposed leftward from the left end face of the reverse roller 461 in the left-right direction.

As shown in FIG. 7, the stopper 521F is positioned to the left of the plate-shaped part 5212. The stopper 521F has a protruding part that protrudes toward the left.

The protruding member 522 has a base part 522A, two first support parts 522B, a second support part 522C, a pressure roller 522D, a restricting part 522E, and a stopper 522F. The base part 522A, the two first support parts 522B, the second support part 522C, the pressure roller 522D, the restricting part 522E, and the stopper 522F respectively correspond to the base part 521A, the two first support parts 521B, the second support part 521C, the pressure roller 521D, and the stopper 521F of the protruding member 521. The base part 522A has plate-shaped parts 5221, 5222, 5223, and 5224 that respectively correspond to the plate-shaped parts 5211, 5212, 5213, and 5214 of the base part 521A. The positional relationships among the protruding member 522, the feed roller 412, and the reverse roller 462 correspond to the positional relationships among the protruding member 521, the feed roller 411, and the reverse roller 461. Hereinafter, the pressure rollers 521D and 522D will also be collectively referred to as pressure rollers 52D.

The bridging member 53 spans between the plate-shaped part 5213 of the base part 521A and the plate-shaped part 5223 of the base part 522A. The bridging member 53 has a protruding part 53A and a plate-shaped part 53B. The plate-shaped part 53B extends orthogonally to the directions of linear motion. The protruding part 53A is provided on a far-side surface of the plate-shaped part 53B. The protruding part 53A protrudes toward the far side from the far-side surface of the plate-shaped part 53B. As shown in FIG. 6, the protruding part 53A is positioned upstream of the pressure rollers 52D in the conveying direction.

As shown in FIGS. 8, 9, and 11, the support member 123 has a support part 124A and a support part 124B. The support part 124A is positioned to the left of the pressing portion 51. The support part 124A has a groove formed in its right surface. The groove formed in the support part 124A extends in the directions of linear motion. The plate-shaped part 5214 of the protruding member 521 is inserted into the groove formed in the support part 124A from the right side thereof. The plate-shaped part 5214 can move within the groove formed in the support part 124A in the directions of linear motion. The support part 124B is positioned to the right of the pressing portion 51. The support part 124B has a groove formed in its left surface. The groove formed in the support part 124B extends in the directions of linear motion. The plate-shaped part 5224 of the protruding member 522 is inserted into the groove formed in the support part 124B from the left side thereof. The plate-shaped part 5224 can move within the groove formed in the support part 124B in the directions of linear motion. Thus, the pressing portion 51 is interposed between the left-right inner sides of the support parts 124A and 124B. The pressing portion 51 is supported by the support parts 124A and 124B so as to be capable of moving in the directions of linear motion.

As shown in FIG. 8, the support member 123 also has a restricting part 127A and a restricting part 127B. In other words, the restricting parts 127A and 127B are part of the second casing 12. The restricting part 127A extends rightward from a left portion of the support member 123, while the restricting part 127B extends leftward from a right portion of the support member 123. When the pressing portion 51 is placed in its furthest position to the near side, the restricting part 127A contacts a bottom surface on the protruding part of the stopper 521F, while the restricting part 127B contacts a bottom surface on the protruding part of the stopper 522F. Since the stoppers 521F and 522F respectively contact the restricting parts 127A and 127B from the far side thereof, further movement of the pressing portion 51 toward the near side is restricted.

FIG. 8 shows a state of the pressing portion 51 after having moved to its furthest position toward the near side at which further movement toward the near side is restricted by the restricting parts 127A and 127B. Hereinafter, the furthest position of the pressing portion 51 toward the near side will be referred to as a first position. When the pressing portion 51 is in the first position, the pressure roller 521D is separated from the feed roller 411 and the pressure roller 522D is separated from the feed roller 412. A distance between the near-side edge of each pressure roller 52D and the corresponding feed roller 41 when the pressing portion 51 is in the first position will be referred to as a distance D1. The distance D1 in the embodiment is approximately 2 mm. Hereinafter, a point on the outer circumferential surface of each pressure roller 52D nearest the corresponding feed roller 41 will be referred to as an end point U (see FIG. 6).

As shown in FIG. 6, the pressure rollers 52D protrude into the conveying region 10C from the second surface 12A when the pressing portion 51 is in the first position. The pressure rollers 52D verge on the conveying path 20 when the pressing portion 51 is in the first position. Here, the term "verge on" includes a case in which the outer circumferential surfaces of the pressure rollers 52D border the conveying path 20, as well as a case in which the outer circumferential surfaces of the pressure rollers 52D are separated from the conveying path 20 by the thickness of one sheet.

An imaginary plane that is oriented in the directions of linear motion and that is tangential to portions of the outer circumferential surfaces of the reverse rollers 46 positioned furthest upstream in the conveying direction will be referred to as an imaginary plane M. An imaginary line extending in the left-right direction and passing through the center of shaft members in the pressure rollers 52D will be referred to as an imaginary line 52P. An imaginary plane passing through both the imaginary line 42P and the imaginary line 52P will be referred to as an imaginary plane L. The end points U of the pressure rollers 52D are respectively positioned upstream of the imaginary plane M in the conveying direction. An acute angle formed by the reference plane K and the imaginary plane L will be referred to as an angle θ2. The angle θ2 is approximately 20° in the embodiment, and more preferably 19.8°.

Figure 12:
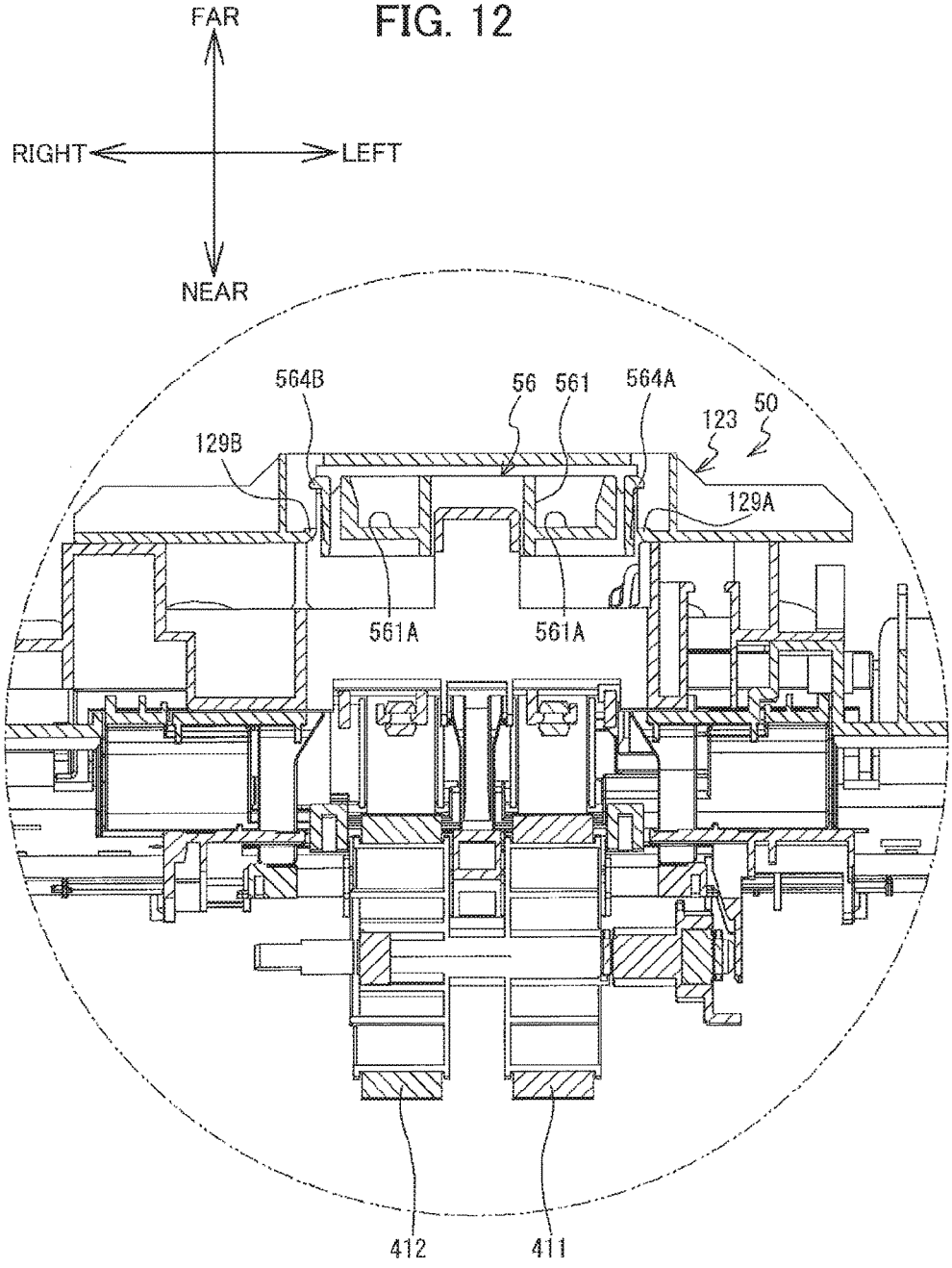
FIG. 12 is a cross-sectional view taken along the line II-II in FIG. 6 as viewed in the direction indicated by arrows, in which the pressing portion 51 is in its second position.

FIGS. 11 and 12 show a state of the pressing portion 51 after having moved to its furthest position toward the far side. Hereinafter, the furthest position of the pressing portion 51 toward the far side will be referred to as a second position. In the second position, the pressing portion 51 is positioned on the second side relative to the second surface 12A of the second casing 12 and further toward the second side than the conveying region 10C (see FIG. 16). Thus, the pressure rollers 52D do not protrude from the second surface 12A into the conveying region 10C when the pressing portion 51 is in the second position.

As shown in FIG. 7, the first spring 54 is a compressed coil spring, for example. The first spring 54 extends in the directions of linear motion. A near-side end portion of the first spring 54 is fitted around the protruding part 53A of the bridging member 53, while a far-side end portion of the first spring 54 is fitted around a protrusion formed at a tubular-shaped part fixedly provided in the second casing 12 (see e.g., FIG. 8). The center of the first spring 54 is aligned with (i.e. coincident with) the centerline 11C in the left-right direction. Here, the center of the first spring 54 denotes the center of a circular cross-section of the compressed coil spring. As shown in FIGS. 8, 9, and 11, a distance in the left-right direction between the center of the first spring 54 and the respective centers in the left-right direction of the feed roller 411 and the pressure roller 521D is equivalent to a distance in the left-right direction between the center of the first spring 54 and the respective centers in the left-right direction of the feed roller 412 and the pressure roller 522D. Hereinafter, the center in the left-right direction between the left end face of the feed roller 411 and the right end face of the feed roller 412 will be referred to as the left-right center of the feed rollers 41. The center of the first spring 54 is aligned with (i.e. coincident with) the left-right center of the feed rollers 41 in the left-right direction. The first spring 54 applies an urging force to the pressing portion 51 in a direction toward the near side. The pressing portion 51 moves toward the near side in response to the urging force received from the first spring 54.

As shown in FIG. 7, the urging portion 55 is disposed on the far side relative to the pressing portion 51. The urging portion 55 has an intermediate member 56, and second springs 571 and 572. Hereinafter, the second springs 571 and 572 will also be collectively referred to as second springs 57. The intermediate member 56 has a base part 561, plate-shaped parts 563A and 563B, and stoppers 564A and 564B.

The base part 561 has a plate-shaped part 561A. The plate-shaped part 561A extends orthogonally to the directions of linear motion. The plate-shaped part 561A confronts the plate-shaped parts 5211 and 5221 of the pressing portion 51. A hole 561B is formed in the center in the left-right direction of the plate-shaped part 561A and penetrates the plate-shaped part 561A in the directions of linear motion. The first spring 54 is inserted into the hole 561B. A protruding part 562A is provided on a far-side surface of the plate-shaped part 561A to the left of the hole 561B. A protruding part 562B is provided on the far-side surface of the plate-shaped part 561A to the right of the hole 561B. The protruding parts 562A and 562B protrude toward the far side. The plate-shaped part 563A extends along the directions of linear motion and protrudes toward the left from the base part 561. The plate-shaped part 563B extends along the directions of linear motion and protrudes toward the right from the base part 561. The stopper 564A is positioned to the left of the plate-shaped part 561A. The stopper 564A has a protruding part that protrudes toward the left. The stopper 564B is positioned to the right of the plate-shaped part 561A. The stopper 564B has a protruding part that protrudes toward the right.

The second springs 57 are compressed coil springs, for example, and extend in the directions of linear motion. A near-side end portion of the second spring 571 is fitted around the protruding part 562A of the intermediate member 56, while a far-side end portion of the second spring 571 is seated on the support member 123 fixed to the second casing 12 (see e.g., FIG. 8). A near-side end portion of the second spring 572 is fitted around the protruding part 562B of the intermediate member 56, while a far-side end portion of the second spring 572 is seated on the support member 123 (see e.g., FIG. 8). As shown in FIGS. 8, 9, and 11, the second spring 571 is positioned such that its center is leftward of the respective centers in the left-right direction of the feed roller 411 and the pressure roller 521D in the left-right direction, while the second spring 572 is positioned such that its center is rightward of the respective centers in the left-right direction of the feed roller 412 and the pressure roller 522D in the left-right direction. Note that the center of each second spring 57 denotes the center of a circular cross-section of the compressed coil spring.

The second springs 571 and 572 are symmetrical in the left-right direction about the center of the first spring 54. Hence, the second springs 571 and 572 are arranged to be symmetrical in the left-right direction about the left-right center of the feed rollers 41 and the center of the first spring 54. A distance in the left-right direction between the center of the first spring 54 and the center of the second spring 571 is equivalent to a distance in the left-right direction between the center of the first spring 54 and the center of the second spring 572. The second springs 571 and 572 apply the same urging force.

The second springs 57 can respectively apply urging forces to the intermediate member 56 in the direction toward the near side. The intermediate member 56 can move toward the near side in response to the urging forces received from the second springs 57. A near-side surface of the plate-shaped part 561A of the base part 561 of the intermediate member 56 contacts the plate-shaped parts 5211 and 5221 of the pressing portion 51 from the far side. Upon receiving the urging forces from the second springs 57, the intermediate member 56 applies an urging force to the plate-shaped parts 5211 and 5221 of the pressing portion 51 in the direction toward the near side. Accordingly, the pressing portion 51 receives urging forces in the direction toward the near side from both the first spring 54 and the urging portion 55.

As shown in FIGS. 8, 9, and 11, the support member 123 also has a support part 126A and a support part 126B. The support part 126A is positioned to the left of the intermediate member 56, while the support part 126B is positioned to the right of the intermediate member 56. The support part 126A has a groove formed in its right surface. The groove formed in the support part 126A extends in the directions of linear motion. The plate-shaped part 563A of the intermediate member 56 is inserted into the groove formed in the support part 126A from the right side thereof. The plate-shaped part 563A can move within the groove formed in the support part 126A in the directions of linear motion. The support part 126B has a groove formed in its left surface. The groove formed in the support part 126B extends in the directions of linear motion. The plate-shaped part 563B of the intermediate member 56 is inserted into the groove formed in the support part 126B from the left side thereof. The plate-shaped part 563B can move within the groove formed in the support part 126B in the directions of linear motion. Thus, the intermediate member 56 is interposed between the left-right inner sides of the support parts 126A and 126B. The intermediate member 56 is supported by the support parts 126A and 126B so as to be capable of moving in the directions of linear motion.

Figure 10:
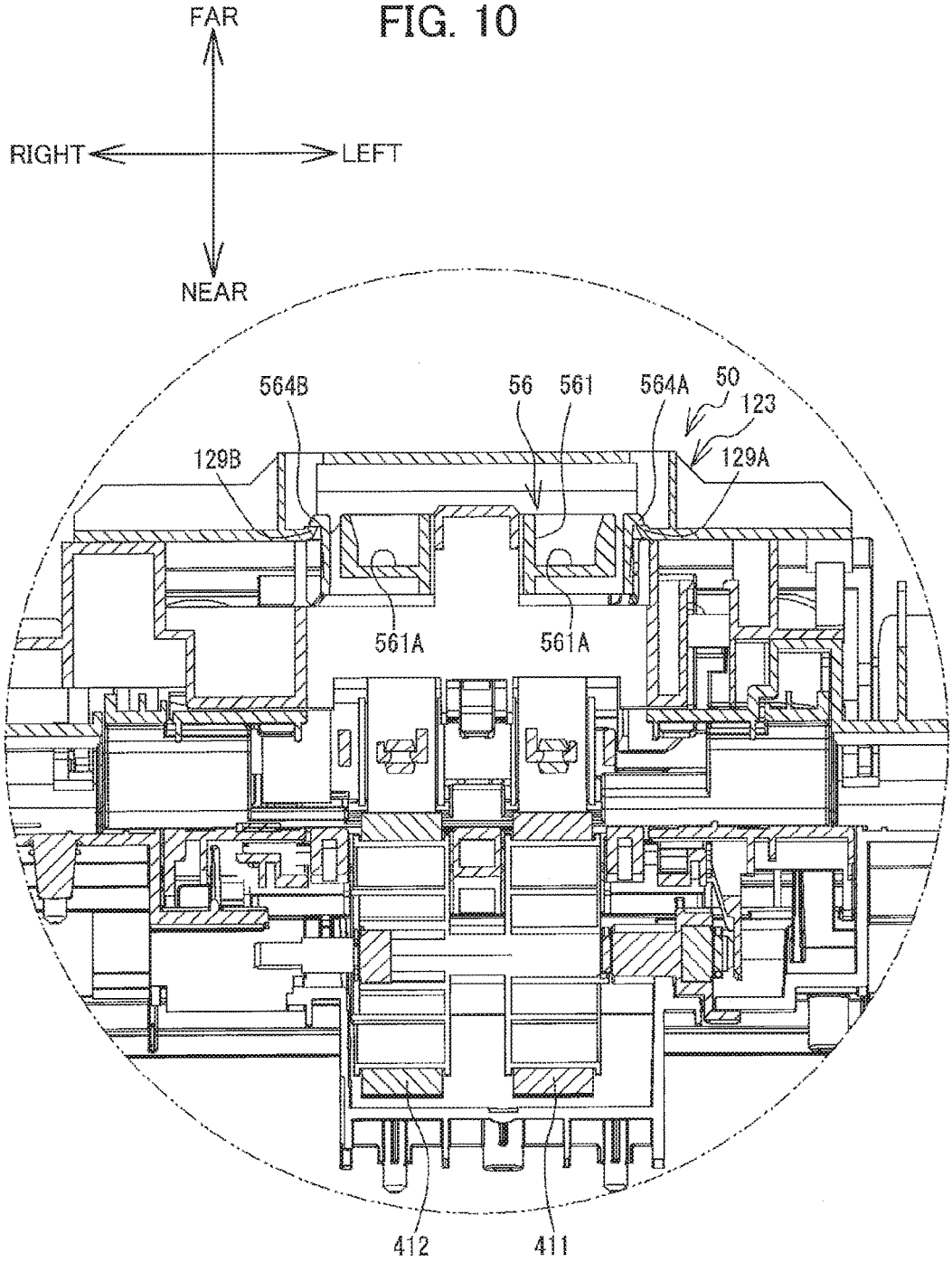
FIG. 10 is a cross-sectional view taken along a line II-II in FIG. 6 as viewed in a direction indicated by arrows, in which the pressing portion 51 is in its third position.

As shown in FIG. 10, the support member 123 also has a restricting part 129A and a restricting part 129B. The restricting part 129A extends rightward from the left portion of the support member 123, while the restricting part 129B extends leftward from the right portion of the support member 123. The restricting part 129A can contact a bottom surface on the protruding part of the stopper 564A of the intermediate member 56. The restricting part 129B can contact a bottom surface on the protruding part of the stopper 564B of the intermediate member 56. Since the stoppers 564A and 564B respectively contact the restricting parts 129A and 129B from the far side thereof, further movement of the intermediate member 56 toward the near side is restricted. Hereinafter, the position of the pressing portion 51 in the directions of linear motion when the pressing portion 51 contacts the near-side end of the intermediate member 56 while the intermediate member 56 is restricted from moving toward the near side by the restricting parts 129A and 129B will be referred to as a third position.

The third position denotes a position in which the pressing portion 51 is closer to the far side than when in the first position (see FIG. 8) and closer to the near side than when in the second position (see FIGS. 11 and 12). As shown in FIG. 9, a distance between the near-side edge of each pressure roller 52D and the conveying path 20 when the pressing portion 51 is in the third position will be referred to as a distance D2. The distance D2 in the embodiment is 6 mm.

Since the restricting parts 129A and 129B restrict movement of the intermediate member 56 toward the near side when the pressing portion 51 is disposed between the first position and the third position, the pressing portion 51 remains separated from the intermediate member 56. Accordingly, only the urging force of the first spring 54 is applied to the pressing portion 51 when the pressing portion 51 is disposed between the first position and the third position. However, while disposed between the third position and the second position, the stoppers 564A and 564B are respectively separated from the restricting parts 129A and 129B, allowing the intermediate member 56 to contact the pressing portion 51. As a result, the pressing portion 51 receives the urging forces in the direction toward the near side from both the first spring 54 and the urging portion 55. When the pressing portion 51 is disposed in the third position, for example, the first spring 54 applies a force of 80 gf to the pressing portion 51, and the second springs 57 apply a force of 50 gf to the pressing portion 51. In other words, when the pressing portion 51 is in the first position, the urging force that the pressing portion 51 receives from the first spring 54 differs from that received from the urging portion 55.

<Cam Portion 60>

Figure 13:
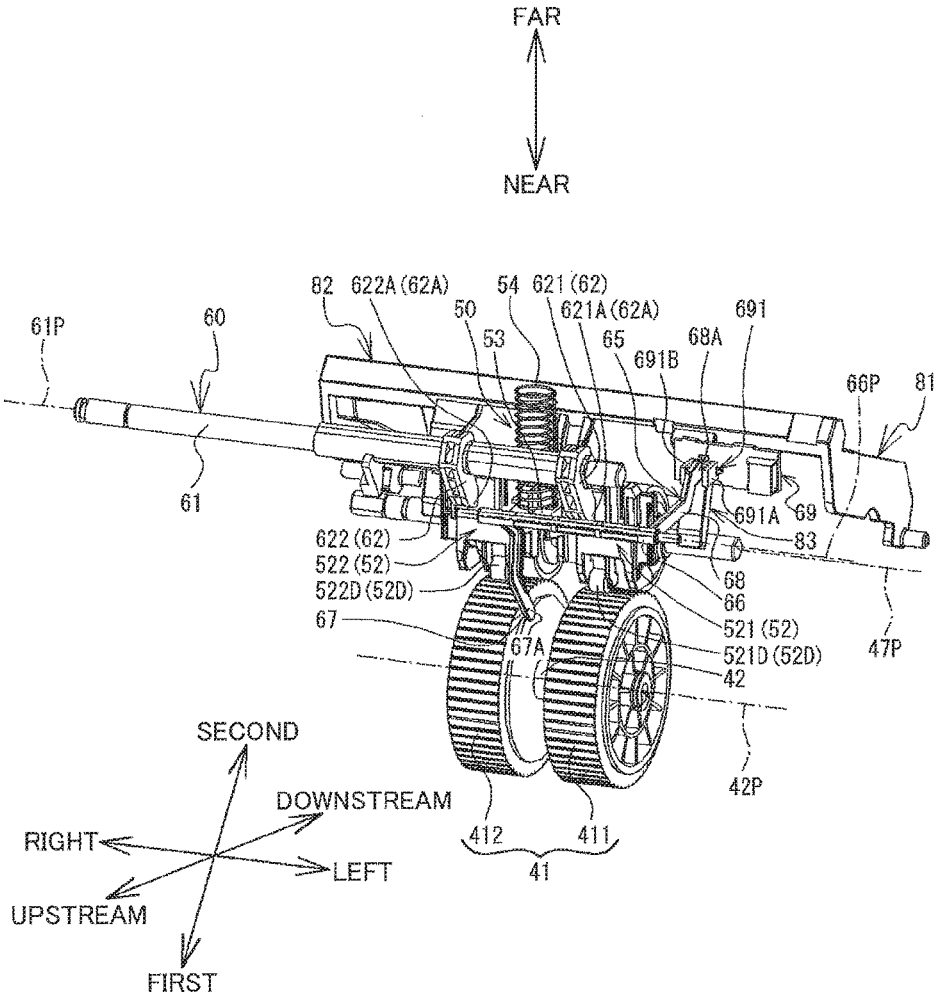
FIG. 13 is a perspective view of a cam portion 60.
Figure 14:
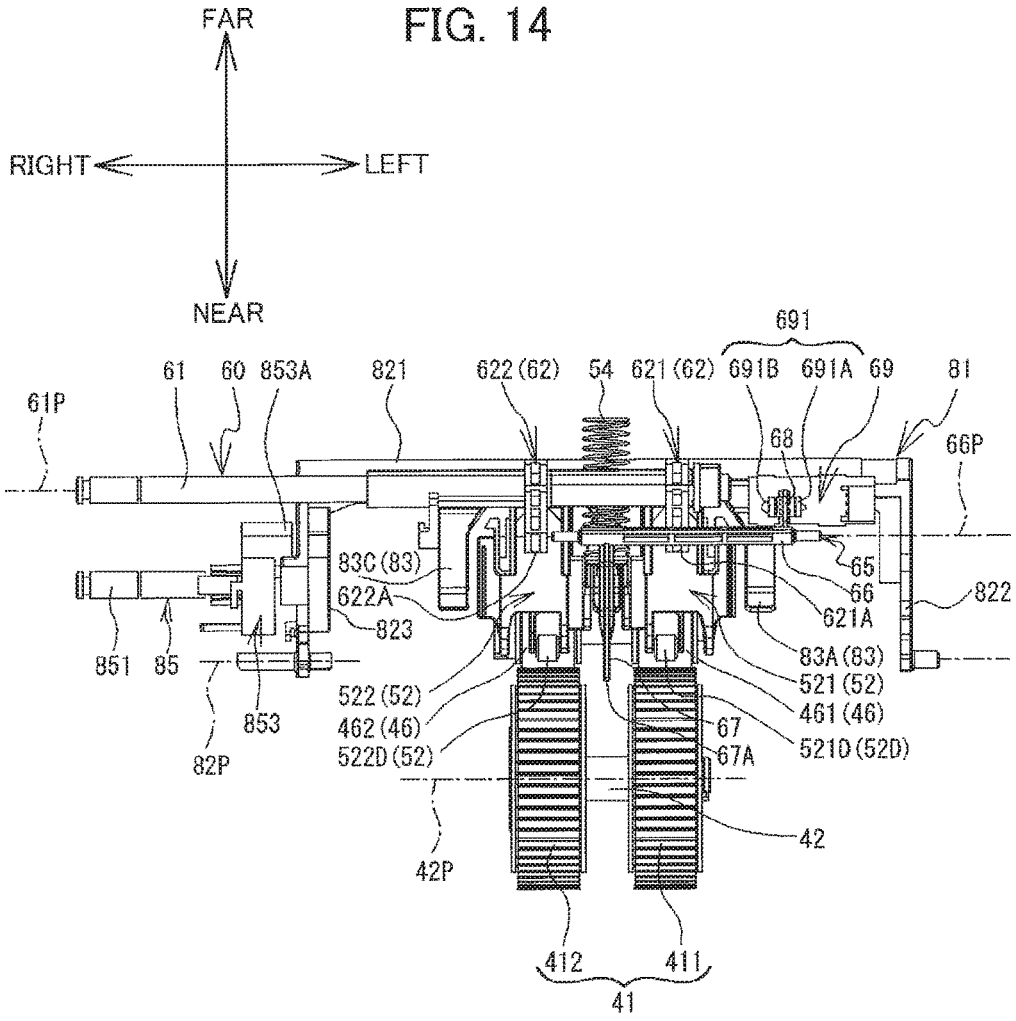
FIG. 14 is a front view of the cam portion 60.

A cam portion 60 shown in FIGS. 13 and 14 is disposed in the second casing 12. The cam portion 60 has a shaft member 61, cams 621 and 622, and a spring 63 (see FIG. 24). The cam portion 60 is provided on the second side relative to the conveying path 20. The cam portion 60 is disposed opposite the conveying region 10C with respect to the second surface 12A of the second casing 12 (see FIGS. 15 and 16).

The shaft member 61 is a rod-shaped member having a substantially circular cross-section. The shaft member 61 is oriented in the left-right direction. The shaft member 61 is disposed upstream of the pressing mechanism 50 in the conveying direction. The shaft member 61 is rotatably supported in the second casing 12 (see FIGS. 15 and 16). A right end of the shaft member 61 is disposed at a right end portion of the second casing 12. A left end of the shaft member 61 is disposed at the approximate same position as a left end of the protruding member 521 of the pressing portion 51 in the left-right direction. The shaft member 61 rotates in response to the rotation of the second motor 72 described later (see FIG. 24). Hereinafter, an imaginary line extending in the left-right direction and passing through the center of the shaft member 61 will be referred to as an imaginary line 61P.

The cams 621 and 622 are provided on the shaft member 61. The cams 621 and 622 have the same shape. Hereinafter, the cams 621 and 622 will also be collectively referred to as cams 62. The cams 62 are disposed upstream of the pressing mechanism 50 in the conveying direction. The cams 62 are plate cams and have a general elliptical shape. The shaft member 61 is connected to each cam 62 at a position biased toward one end along a major axis of the cam 62. Thus, a distance from the imaginary line 61P of the shaft member 61 to an end of the cam 62 opposite the end at which the shaft member 61 is connected is longer than a distance from the imaginary line 61P to the end of the cam 62 at which the shaft member 61 is connected. The end of the cam 621 opposite the end at which the shaft member 61 is connected will be referred to as a cam end 621A, and the end of the cam 622 opposite the end at which the shaft member 61 is connected will be referred to as a cam end 622A. The cam ends 621A and 622A will also be collectively referred to as cam ends 62A. The cams 62 rotate about the imaginary line 61P in response to the rotation of the shaft member 61.

The cam 621 is disposed upstream of the protruding member 521 of the pressing portion 51 of the pressing mechanism 50 in the conveying direction, and the cam 622 is disposed upstream of the protruding member 522 of the pressing portion 51 of the pressing mechanism 50 in the conveying direction. The cams 621 and 622 are arranged to be symmetrical in the left-right direction about the first spring 54 provided between the protruding members 521 and 522. A distance between the center of the first spring 54 and an end of the cam 621 nearest the center of the first spring 54 (i.e. a right end face of the cam 621) is equivalent to a distance between the center of the first spring 54 and an end of the cam 622 nearest the center of the first spring 54 (i.e. a left end face of the cam 622) in the left-right direction. The thickness of each cam 62 in the left-right direction is smaller than a dimension in the left-right direction of the plate-shaped part 5211 of the protruding member 521 and also smaller than a dimension in the left-right direction of the plate-shaped part 5221 of the protruding member 522.

The spring 63 (see FIG. 24) is wound about the shaft member 61 at a position to the right of the cam 622. The spring 63 urges the shaft member 61 to rotate counterclockwise.

Figure 15:
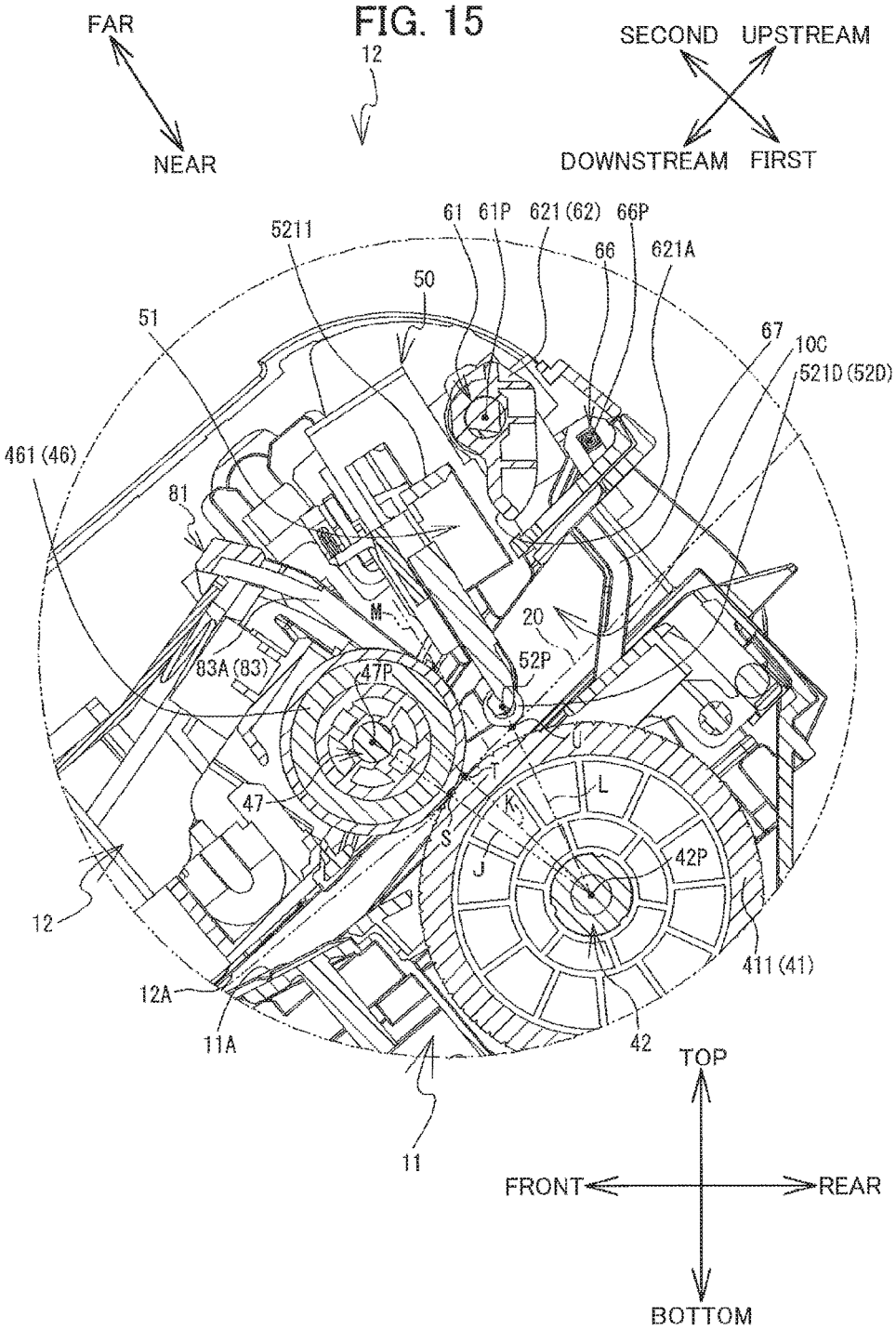
FIG. 15 is a partial enlarged cross-sectional view taken along the center line 11C in FIG. 2 as viewed from a right side thereof, in which the pressing portion 51 is in its first position.

As shown in FIG. 15, the cam 621 does not contact the plate-shaped part 5211 of the pressing portion 51 when the cam end 621A of the cam 621 extends downward from the shaft member 61. While not shown in the drawings, the cam 622 also does not contact the plate-shaped part 5221 of the pressing portion 51 when the cam end 622A of the cam 622 extends downward from the shaft member 61. In this state, the pressing portion 51 moves toward the near side in response to the urging forces in the direction toward the near side received from the first spring 54 and the urging portion 55 (see FIG. 7).

Figure 16:
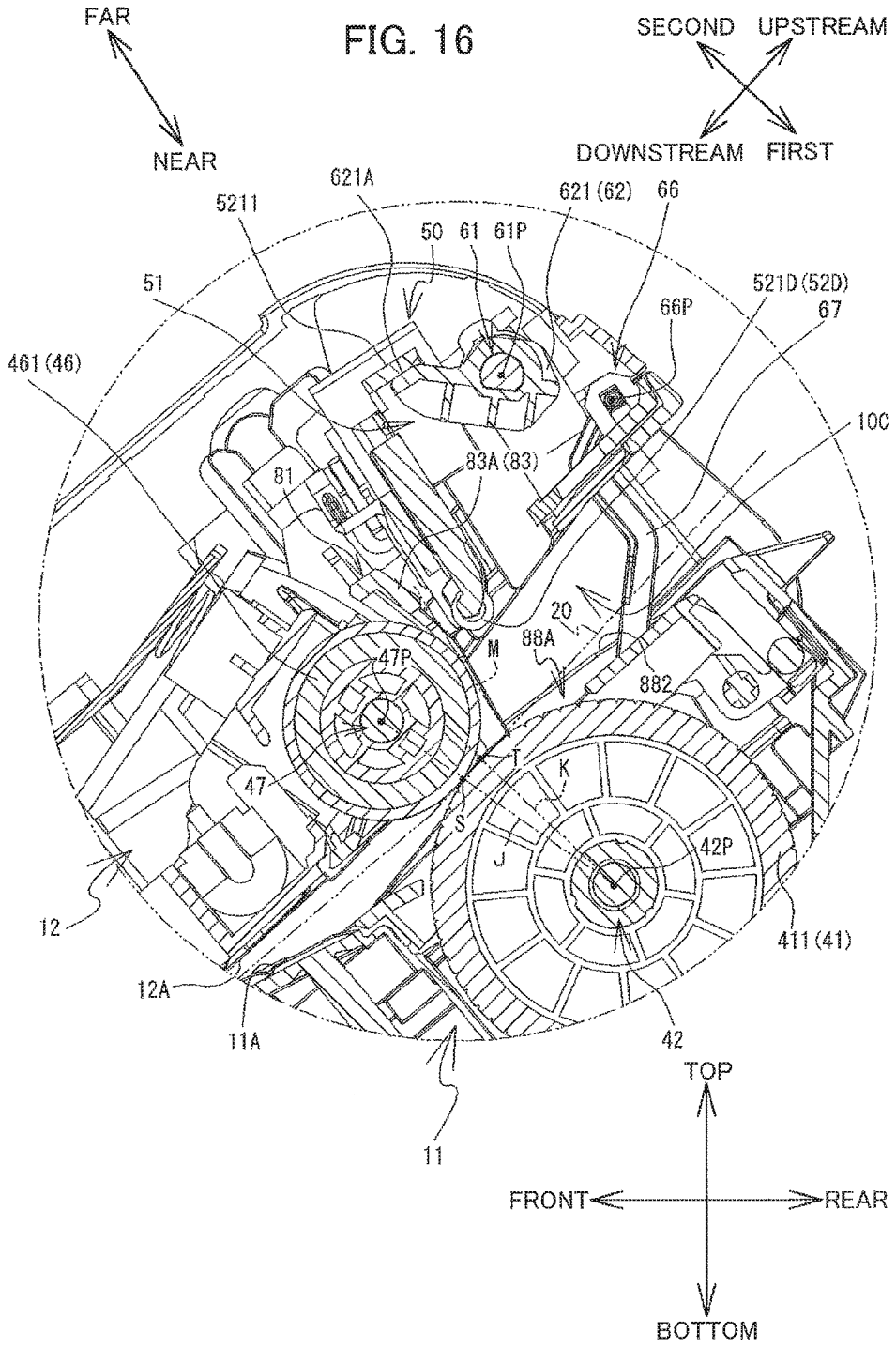
FIG. 16 is a partial enlarged cross-sectional view taken along the center line 11C in FIG. 2 as viewed from a right side thereof, in which the pressing portion 51 is in its second position.

However, when the shaft member 61 rotates clockwise from the state shown in FIG. 15, the cam end 621A of the cam 621 contacts a bottom surface of the plate-shaped part 5211 of the pressing portion 51, and the cam end 622A of the cam 622 contacts a bottom surface of the plate-shaped part 5221 of the pressing portion 51. Thus, a force in the direction toward the far side is applied to the pressing portion 51 as the cams 62 rotate. Consequently, the pressing portion 51 moves toward the far side against the urging forces of the first spring 54 and the urging portion 55. As shown in FIG. 16, the shaft member 61 rotates until the cam end 621A of the cam 621 extends upward from the shaft member 61. While not shown in the drawings, the cam end 622A of the cam 622 also extends upward from the shaft member 61 as the shaft member 61 rotates. As the cams 621 and 622 rotate, the pressing portion 51 moves from the first position (see FIG. 8) into the second position (see FIGS. 11 and 12) through the third position (see FIGS. 9 and 10).

The urging portion 55 forces the plate-shaped part 561A to contact the plate-shaped parts 5211 and 5221 of the pressing portion 51 from the second side (i.e., the far side), applying the urging forces of the second springs 57 to the pressing portion 51. In response, the cam 621 forces the cam end 621A to contact the plate-shaped part 5211 of the pressing portion 51 from the first side (i.e., the near side), applying a force to the pressing portion 51 in the direction toward the far side. The cam 622 forces the cam end 622A to contact the plate-shaped part 5221 of the pressing portion 51 from the first side (i.e., the near side), applying a force to the pressing portion 51 in the direction toward the far side. Hence, the position at which the urging force of the urging portion 55 is applied to the pressing portion 51 and the positions at which the forces of the cams 62 are applied to the pressing portion 51 are the same relative to the conveying direction. Further, the first spring 54 passes through the hole 561B formed in the plate-shaped part 561A and connects to the bridging member 53 of the pressing portion 51. Thus, the position of the first spring 54 and the position of the plate-shaped part 561A are identical with respect to the conveying direction. Accordingly, the position at which the urging force of the first spring 54 is applied to the pressing portion 51 is the same as the position at which the urging force of the urging portion 55 is applied to the pressing portion 51 with respect to the conveying direction. Therefore, the position at which the urging force of the first spring 54 is applied to the pressing portion 51, the position at which the urging force of the urging portion 55 is applied to the pressing portion 51, and the position at which the force of the cams 62 is applied to the pressing portion 51 are all equivalent with respect to the conveying direction.

<Rotary Member 65>

A rotary member 65 shown in FIGS. 13 and 14 is provided at the second casing 12. The rotary member 65 has a shaft member 66, a first extension member 67, and a second extension member 68. The shaft member 66 is a rod-shaped member having a substantially circular cross-section. The shaft member 66 is oriented in the left-right direction. The shaft member 66 is disposed upstream of the pressing mechanism 50 in the conveying direction. The shaft member 66 is positioned upstream of the shaft member 61 of the cam portion 60 in the conveying direction and on the first side relative to the shaft member 61 of the cam portion 60. The shaft member 66 is rotatably supported in the second casing 12. Hereinafter, an imaginary line extending in the left-right direction and passing through the center of the shaft member 66 will be referred to as an imaginary line 66P. A right end of the shaft member 66 is positioned to the right of a portion of the pressing portion 51 between the protruding members 521 and 522 in the left-right direction. A left end of the shaft member 66 is positioned to the left of the left end of the protruding member 521 of the pressing portion 51 in the left-right direction.

The first extension member 67 and the second extension member 68 are plate-shaped members extending from the shaft member 66. The first extension member 67 is provided near the right end of the shaft member 66, while the second extension member 68 is provided near the left end of the shaft member 66. The first extension member 67 and the second extension member 68 extend from the shaft member 66 in different directions from each other. Specifically, the first extension member 67 extends toward the first side from the shaft member 66, while the second extension member 68 extends downstream from the shaft member 66 in the conveying direction. The first extension member 67 and the second extension member 68 rotate about the imaginary line 66P in response to the rotation of the shaft member 66. Consequently, the extended direction of the first extension member 67 and the extended direction of the second extension member 68 vary as the shaft member 66 rotates.

As shown in FIG. 13, the first extension member 67 extends from the shaft member 66 toward the first side, then bends and extends further in a direction sloped diagonally toward the first side and downstream. As shown in FIG. 14, the position of the first extension member 67 in the left-right direction is aligned with (i.e. coincident with) the left-right center of the feed rollers 411 and 412, i.e., the left-right center of the feed rollers 41. The shaft member 66 is rotated counterclockwise by the weight of the second extension member 68. In this state, the first extension member 67 passes through the conveying region 10C from the second side to the first side as illustrated in FIGS. 15 and 16. A distal end 67A of the first extension member 67 (see FIG. 13) farthest from the shaft member 66 is positioned further toward the first side than the first surface 11A of the first casing 11.

As shown in FIG. 13, the second extension member 68 is positioned to the left of the protruding member 521 of the pressing portion 51. The second extension member 68 extends from a portion of the shaft member 66 positioned leftward of the left end of the pressing portion 51 in the left-right direction. When the shaft member 66 has rotated counterclockwise due to the weight of the second extension member 68, the second extension member 68 extends downstream from the shaft member 66 in the conveying direction. The second extension member 68 then bends and extends further from the shaft member 66 in a direction sloped diagonally toward the second-side direction and downstream. As shown in FIG. 14, the second extension member 68 passes along the left side relative to the protruding member 521 of the pressing mechanism 50.

A control board 69 is provided at a position leftward of the pressing portion 51 in the left-right direction. When the shaft member 66 has rotated counterclockwise due to the weight of the second extension member 68, the control board 69 is positioned downstream in the conveying direction of a distal end 68A of the second extension member 68 farthest from the shaft member 66. A photosensor 691 is mounted on the control board 69. The photosensor 691 is electrically connected to the control section 131 (see FIG. 1). The photosensor 691 has a light-emitting portion 691A, and a light-receiving portion 691B. The light-emitting portion 691A and the light-receiving portion 691B are juxtaposed in the left-right direction and are arranged to face each other. The photosensor 691 detects when light emitted from the light-emitting portion 691A has been received by the light-receiving portion 691B and outputs a signal indicative of the detection results to the control section 131.

When the shaft member 66 has rotated counterclockwise due to the weight of the second extension member 68, the distal end 68A of the second extension member 68 is positioned between the light-emitting portion 691A and the light-receiving portion 691B, as illustrated in FIG. 13. In this state, light emitted from the light-emitting portion 691A is not received by the light-receiving portion 691B.

However, when a sheet is conveyed from the upstream side toward the downstream side of the conveying path 20, a downstream edge of the conveyed sheet contacts the first extension member 67 of the rotary member 65, forcing the distal end 67A of the first extension member 67 to move downstream along with the conveyed sheet. As a result, the first extension member 67 rotates the shaft member 66 clockwise. When the shaft member 66 rotates clockwise, the distal end 68A of the second extension member 68 moves toward the second side from a position between the light-emitting portion 691A and the light-receiving portion 691B of the photosensor 691. In this way, the distal end 68A of the second extension member 68 is positioned on the second side relative to the light-emitting portion 691A and the light-receiving portion 691B. As a result, the light-receiving portion 691B receives light emitted from the light-emitting portion 691A.

<Shutter Mechanism 80>

Figure 17:
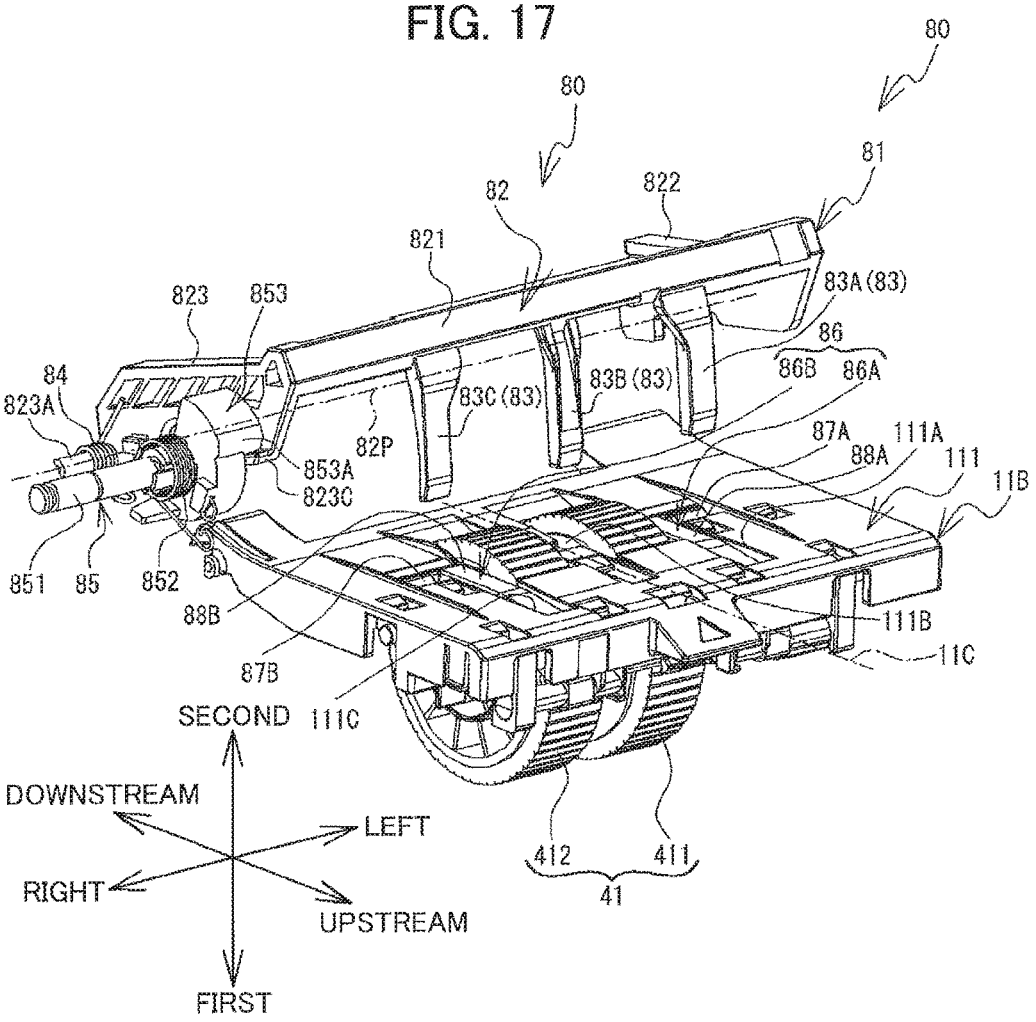
FIG. 17 is a perspective view of a shutter mechanism 80 that includes a shutter 81 disposed in a permitting position.
Figure 18:
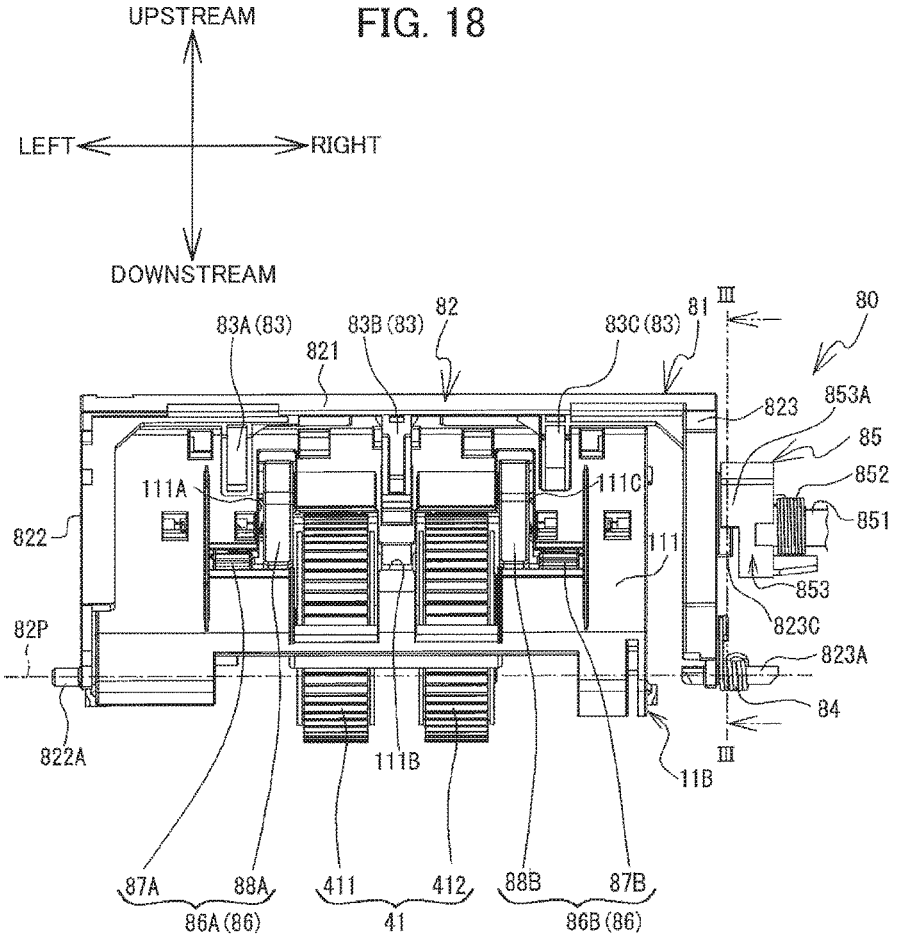
FIG. 18 is a plan view of the shutter mechanism 80.

As shown in FIGS. 17 and 18, a shutter mechanism 80 has a shutter 81, a drive portion 85, and the set guide 86.

The shutter 81 includes a support member 82, an extension member 83, and a spring 84. The support member 82 has a first portion 821, and second portions 822 and 823. The first portion 821 and the second portions 822 and 823 are all disposed in the second casing 12. The first portion 821 is a bar-shaped member that extends in the left-right direction. The second portions 822 and 823 are plate-shaped members. The second portion 822 extends downstream from a left end of the first portion 821 in the conveying direction. The second portion 823 extends downstream from a right end of the first portion 821 in the conveying direction. Side surfaces of the second portions 822 and 823 face in the left and right directions.

A shaft part 822A is provided on a downstream end of the second portion 822. The shaft part 822A extends leftward from a left surface of the second portion 822. A shaft part 823A is provided on a downstream end of the second portion 823. The shaft part 823A extends rightward from a right surface of the second portion 823. The shaft parts 822A and 823A extend along an imaginary straight line 82P oriented in the left-right direction. The shaft parts 822A and 823A are rotatably supported in the second casing 12. As shown in FIG. 4, the imaginary line 82P is arranged downstream from the reverse rollers 46 in the conveying direction.

As shown in FIGS. 17 and 18, the spring 84 is wound around the shaft part 823A. The spring 84 is a torsion coil spring, for example. One end of the spring 84 is fixed to the second portion 823, while the other end of the spring 84 is fixed to the second casing 12. The spring 84 urges the support member 82 to rotate counterclockwise. A protruding part 823C is provided on a right end of the second portion 823. The protruding part 823C protrudes rightward. The protruding part 823C is a plate-shaped member that extends along a first-side edge of the second portion 823.

The extension member 83 includes extension parts 83A, 83B, and 83C. The extension parts 83A, 83B, and 83C all extend toward the first side from the support member 82 in a direction orthogonal to the left-right direction. The extension part 83B is positioned in the center in the left-right direction of the support member 82. The extension part 83A is positioned to the left of the extension part 83B, and the extension part 83C is positioned to the right of the extension part 83B. As shown in FIG. 18, the extension part 83B is disposed between the feed rollers 411 and 412 in the left-right direction. The extension part 83A is positioned to the left of the feed roller 411 in the left-right direction, while the extension part 83C is positioned to the right of the feed roller 412 in the left-right direction.

The drive portion 85 includes a shaft member 851, a spring 852, and a cam 853. The shaft member 851 is positioned to the right of the second portion 823 of the support member 82. The shaft member 851 is oriented in the left-right direction. The shaft member 851 is rotatably supported in the second casing 12. The shaft member 851 rotates in response to the rotation of a second motor 72 described later (see FIG. 24).

Figure 19:
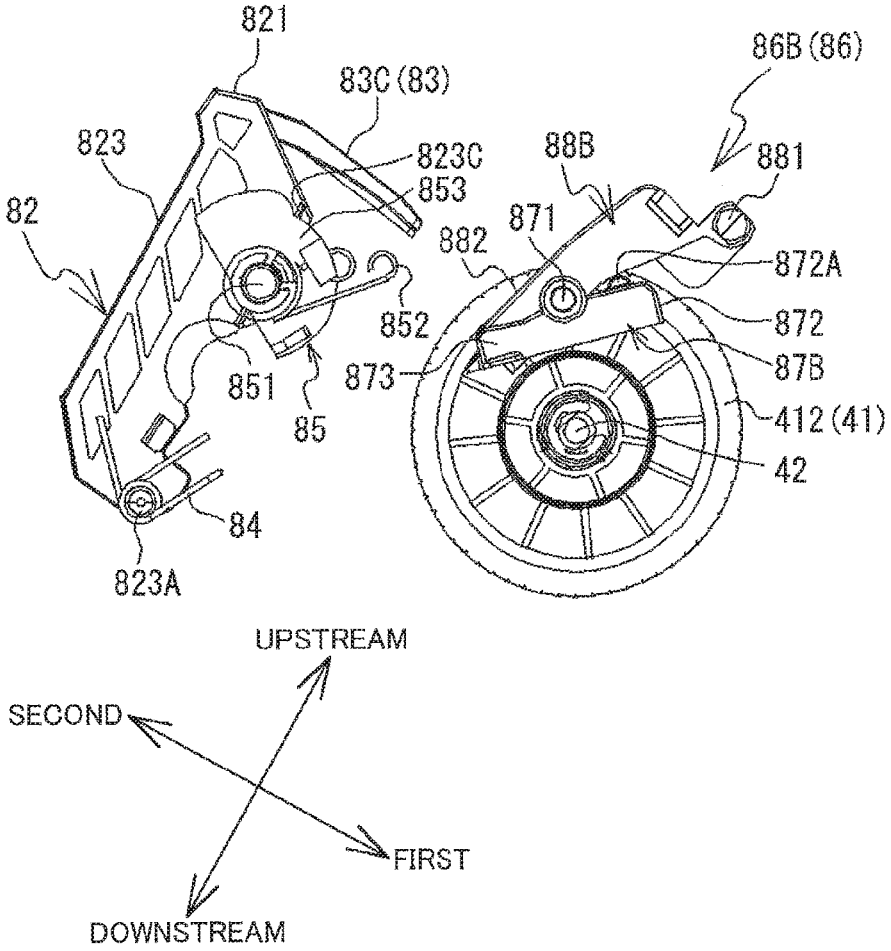
FIG. 19 is a side view of the shutter mechanism 80 that includes the shutter 81 disposed in the permitting position, from which a support member 11B has been removed.

The cam 853 is provided on a left end of the shaft member 851. As shown in FIG. 19, the cam 853 is a plate cam having a semicircular shape. Side surfaces of the cam 853 respectively face in the left and right directions. The cam 853 rotates in response to the rotation of the shaft member 851. The spring 852 is wound around the shaft member 851 at a position to the right of the cam 853. The spring 852 is a torsion coil spring, for example. One end of the spring 852 is fixed to the cam 853, while the other end of the spring 852 is fixed to the second casing 12. The spring 852 urges the drive portion 85 to rotate counterclockwise.

Figure 20:
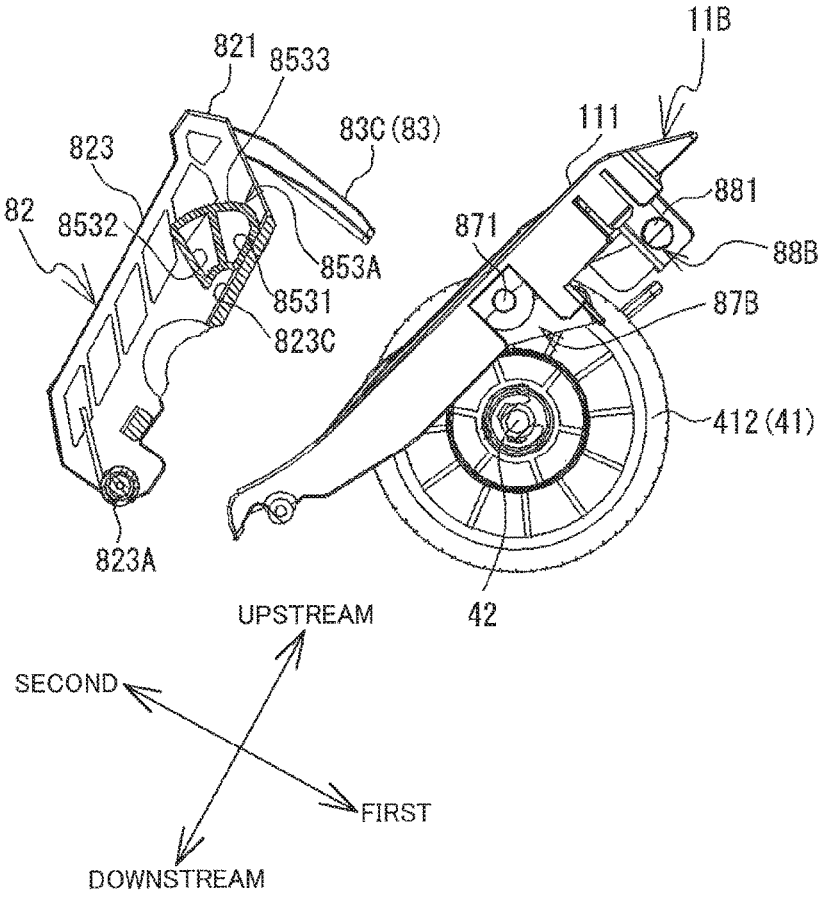
FIG. 20 is a cross-sectional view of the shutter mechanism 80 taken along a line III-III in FIG. 18 as viewed in a direction indicated by arrows, in which the shutter 81 is in its permitting position.

A protruding part 853A is provided on a left surface of the cam 853. As shown in FIG. 20, the protruding part 853A has a general sector shape in cross-section, with a central angle of approximately 60°. The protruding part 853A has radial parts 8531 and 8532, and an arc part 8533. The radial parts 8531 and 8532 extend linearly outward from the shaft member 851 (see FIG. 19). The arc part 8533 extends between respective outer ends of the radial parts 8531 and 8532 while curving outward. The arc part 8533 forms part of the arc of the cam 853. The protruding part 853A contacts a second-side surface of the protruding part 823C of the second portion 823 of the support member 82. The protruding part 853A rotates in response to the rotation of the cam 853.

As shown in FIG. 17, the support member 11B is arranged around the feed rollers 41. A first-side surface 111 of the support member 11B forms part of the first surface 11A (see FIG. 3). The centerline 11C of the first surface 11A indicates the left-right center position of the first-side surface 111. Openings 111A, 111B, and 111C are formed in the first-side surface 111 of the support member 11B. The opening 111A is formed to the left of the centerline 11C. The opening 111C is formed to the right of the centerline 11C. The opening 111B is formed along the centerline 11C. The support member 11B supports the set guide 86 at a position further toward the first side than the first-side surface 111.

The set guide 86 has set guides 86A and 86B. The set guide 86A is positioned to the left of the feed roller 411, while the set guide 86B is positioned to the right of the feed roller 412. The shapes of the set guides 86A and 86B are symmetrical in the left-right direction. For this reason, only the set guide 86B will be described in detail below, while a description of the set guide 86A will be simplified.

As shown in FIGS. 18 and 19, the set guide 86B has a first member 87B and a second member 88B. The first member 87B and the second member 88B extend in the conveying direction. The first member 87B is positioned to the right of the second member 88B in the left-right direction. A shaft part 871 is provided on a center portion of the first member 87B in the conveying direction. The shaft part 871 is oriented in the left-right direction. The shaft part 871 is rotatably supported in the first casing 11. The first member 87B can rotate about the shaft part 871. An upstream end 872 of the first member 87B in the conveying direction extends leftward and advances beneath the second member 88B. A protruding part 872A is provided on a top surface of the upstream end 872. The protruding part 872A protrudes upward from the top surface of the upstream end 872 and contacts a bottom surface of the second member 88B.

A shaft part 881 is provided on an upstream end of the second member 88B. The shaft part 881 is disposed upstream of the first member 87B in the conveying direction. The shaft part 881 is oriented in the left-right direction. The shaft part 881 is rotatably supported in the first casing 11. The second member 88B can rotate about the shaft part 881. The second member 88B is supported from below by the protruding part 872A of the first member 87B. As shown in FIG. 17, a portion of the first member 87B and a portion of the second member 88B are exposed in the opening 111C.

As shown in FIG. 18, the set guide 86A has a first member 87A and a second member 88A. The first member 87A and the second member 88A of the set guide 86A correspond to the first member 87B and the second member 88B of the set guide 86B, respectively. A portion of the first member 87A and a portion of the second member 88A are exposed in the opening 111A.

Next, operations of the shutter mechanism 80 when the shaft member 851 of the drive portion 85 is rotated will be described.

First, a case in which the shaft member 851 is rotated so that the cam 853 is brought into a state shown in FIGS. 17, 19, and 20 will be described. The urging force of the spring 84 rotates the support member 82 counterclockwise until the protruding part 823C of the second portion 823 contacts the radial part 8531 of the protruding part 853A. The extension member 83 of the shutter 81 moves toward the second side and separates from the support member 11B. As shown in FIG. 15, the shutter 81 is disposed in the second casing 12. As shown in FIG. 6, a near-side end of the extension member 83 is positioned further toward the far side than the second surface 12A. In other words, the extension member 83 does not protrude into the conveying region 10C through the second surface 12A and, hence, is not positioned in the conveying region 10C. As shown in FIG. 6, the extension member 83 is positioned downstream in the conveying direction from the imaginary plane M that is tangential to the furthest upstream surfaces of the reverse rollers 46 in the conveying direction. Hereinafter, a position of the shutter 81 when the extension member 83 of the shutter 81 is not positioned in the conveying region 10C will be referred to as a permitting position. When in the permitting position, the shutter 81 is arranged on the second side relative to the conveying path 20.

When the shutter 81 is disposed in the permitting position shown in FIG. 19, the first member 87B of the set guide 86B rotates clockwise about the shaft part 871 due to the weight applied by its upstream end 872. Accordingly, the upstream end 872 of the first member 87B moves downward. As the upstream end 872 moves downward, the second member 88B, which is supported from below by the protruding part 872A, rotates counterclockwise about the shaft part 881. Thus, a second-side surface 882 of the second member 88B moves further toward the first side than the first-side surface 111 of the support member 11B, as shown in FIGS. 15, 17, and 20. Note that the set guide 86A operates in a similar manner, with a second-side surface 882 of the second member 88A moving to a position further toward the first side than the first-side surface 111 of the support member 11B.

Next, a case in which the shaft member 851 is rotated clockwise so that the cam 853 is brought into a state shown in FIGS. 21, 22, and 23 will be described. In this case, the arc part 8533 of the protruding part 853A of the cam 853 contacts the protruding part 823C of the second portion 823. At this time, a distance between the shaft member 851 of the drive portion 85 and the protruding part 823C is greater than a distance between the shaft member 851 of the drive portion 85 and the protruding part 823C when the shutter 81 is in the permitting position. The support member 82 rotates clockwise against the urging force of the spring 84, so that the extension member 83 of the shutter 81 approaches the support member 11B. The extension parts 83A, 83B, and 83C respectively enter the openings 111A, 111B, and 111C formed in the support member 11B from the second side thereof. In this state, the extension member 83 protrudes through the second surface 12A of the second casing 12 into the conveying region 10C and crosses the conveying path 20 from the second side to the first side.

More specifically, when the shaft member 851 rotates clockwise, the extension member 83 of the shutter 81 moves past a position upstream of the contact points S at which the reverse rollers 46 contact the corresponding feed rollers 41 and downstream of the pressure rollers 52D of the pressing mechanism 50 in the conveying direction, as shown in FIG. 16. An upstream surface of the extension member 83 of the shutter 81 crosses the conveying path 20 from the second side to the first side at a position upstream of the contact point T, where each feed roller 41 verges on the conveying path 20, in the conveying direction and a position substantially equal to a position of the imaginary plane M tangential to the furthest upstream surfaces of the reverse rollers 46 in the conveying direction. Note that a near-side end of the pressing portion 51 (i.e. the pressure rollers 52D) is disposed upstream of the imaginary plane M in the conveying direction. Accordingly, an upstream edge of the shutter 81 (specifically, the upstream surface of the extension member 83) in the conveying direction is positioned upstream of the contact points S and downstream of the pressure rollers 52D of the pressing portion 51 in the conveying direction. Hereinafter, a position of the shutter 81 when the extension member 83 of the shutter 81 is disposed in the conveying region 10C with the upstream surface of the extension member 83 crossing a portion of the conveying path 20 downstream of the imaginary plane M and upstream of the contact points S in the conveying direction will be referred to as a restricting position.

Figure 22:
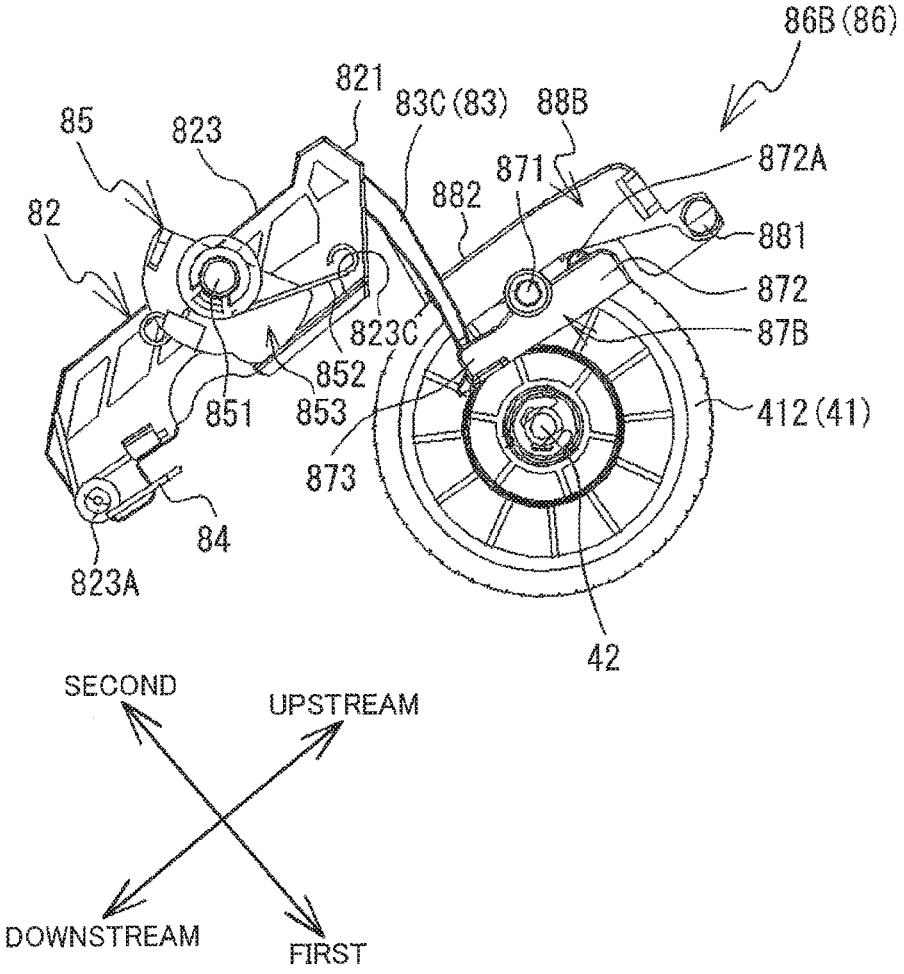
FIG. 22 is a side view of the shutter mechanism 80 that includes the shutter 81 disposed in the restricting position, from which the support member 11B has been removed.
Figure 23:
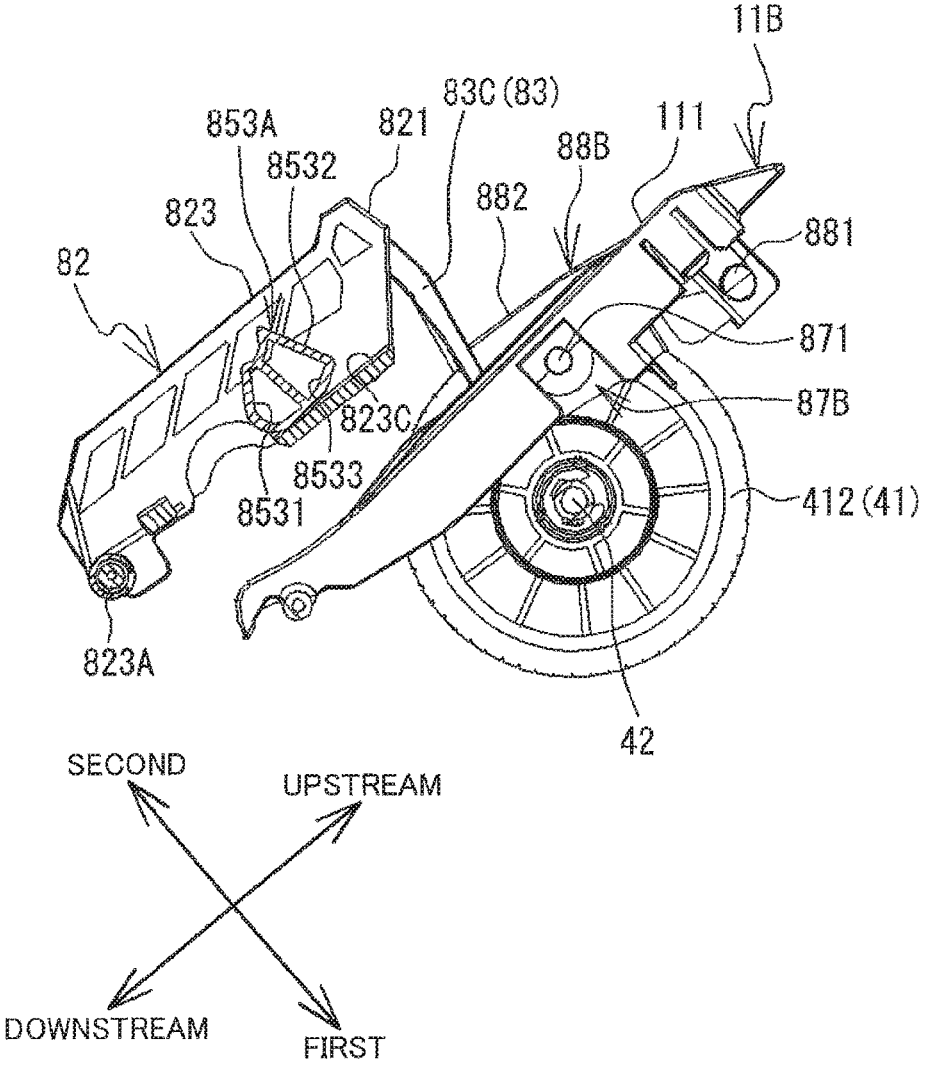
FIG. 23 is a cross-sectional view of the shutter mechanism 80 taken along the line III-III in FIG. 18 as viewed in the direction indicated by arrows, in which the shutter 81 is in its restricting position.

When the shutter 81 is disposed in the restricting position as shown in FIGS. 22 and 23, the extension part 83C of the shutter 81 presses a downstream end 873 of the first member 87B downward. Consequently, the first member 87B rotates counterclockwise about the shaft part 871, moving the upstream end 872 of the first member 87B upward. When the upstream end 872 of the first member 87B moves upward, the protruding part 872A pushes the second member 88B upward. The second member 88B rotates clockwise about the shaft part 881. Thus, the second-side surface 882 of the second member 88B protrudes from the first-side surface 111 of the support member 11B toward the second side. As shown in FIGS. 16 and 23, the second-side surface 882 of the second member 88B is positioned further toward the second side than the second-side edge (i.e. second-side portion of the outer circumferential surface) of the feed roller 412. Note that the set guide 86A operates in a similar manner, with the second-side surface 882 of the second member 88A moving to a position further toward the second side than the second-side edge of the feed roller 411.

<Drive Mechanism 70>

Figure 24:
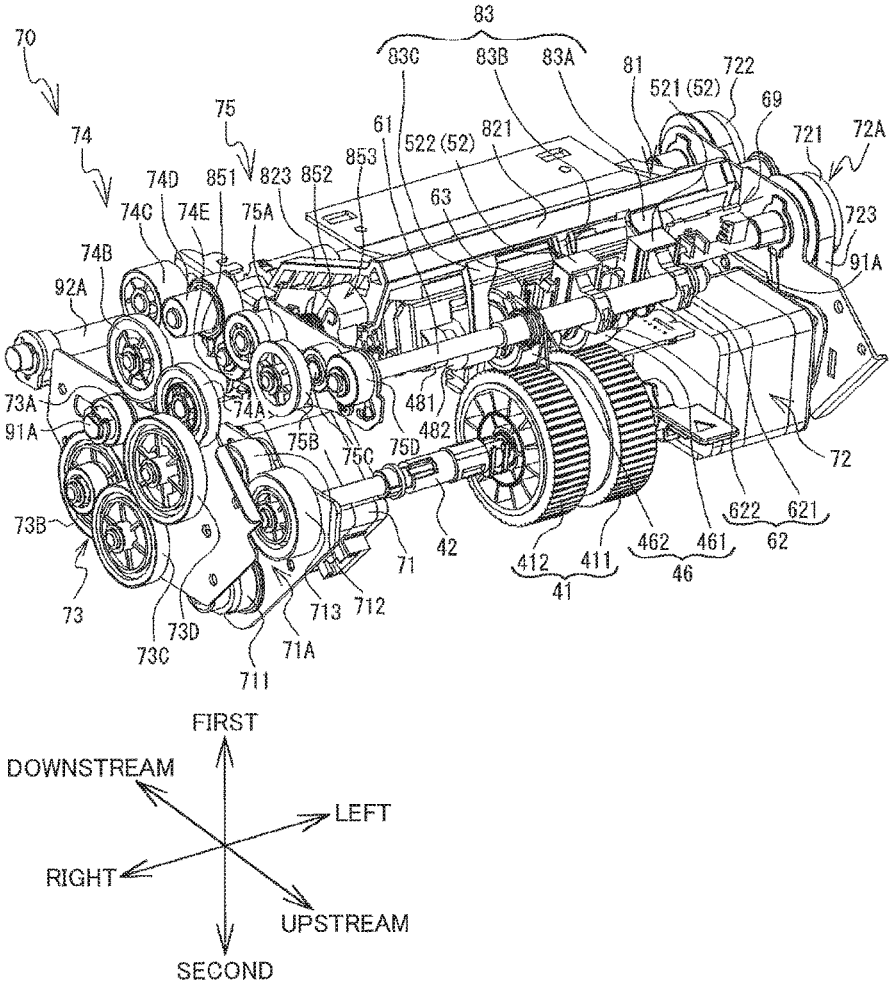
FIG. 24 is a perspective view of a drive mechanism 70.
Figure 25:
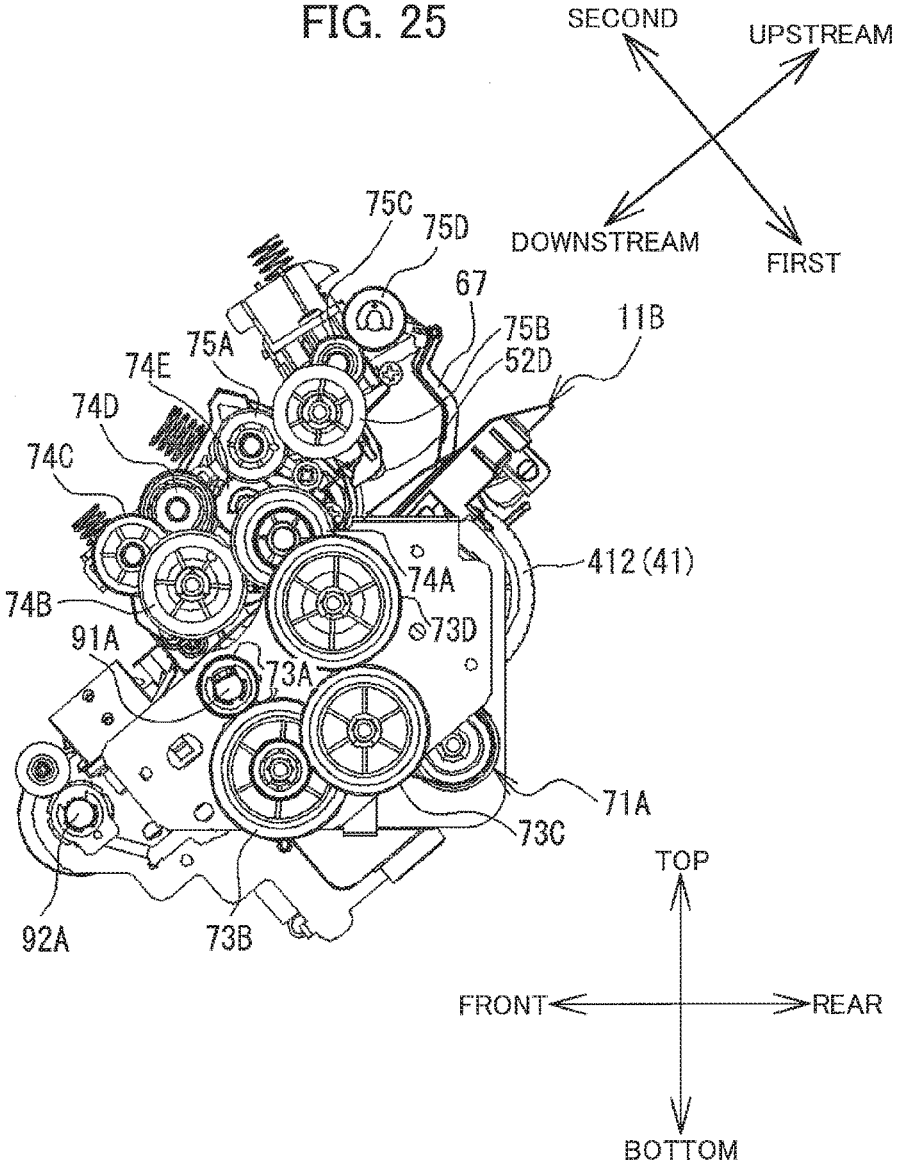
FIG. 25 is a right side view of the drive mechanism 70.

As shown in FIGS. 24 and 25, a drive mechanism 70 includes the first motor 71, the second motor 72, and transmission mechanisms 71A, 72A, 73, 74, and 75. The first motor 71, the second motor 72, and the transmission mechanisms 71A, 72A, and 73 are disposed in the first casing 11, while the transmission mechanisms 74 and 75 are disposed in the second casing 12. As shown in FIG. 24, the transmission mechanism 72A is positioned to the left of the feed rollers 41 and the reverse rollers 46 in the left-right direction. The transmission mechanisms 71A, 73, 74, and 75 are positioned to the right of the feed rollers 41 and the reverse rollers 46 in the left-right direction.

The first motor 71 is disposed in a right portion of the first casing 11. The first motor 71 has a rotational shaft that extends rightward. The transmission mechanism 71A is positioned to the right of the first motor 71. The transmission mechanism 71A includes gears 711, 712, 713, and the like; and a belt (not shown). The gears 711-713 rotate and the belt moves in response to the rotation of the first motor 71. The gear 713 is connected to a right end portion of the shaft member 42 of the feed rollers 41. The transmission mechanism 71A transmits a drive force of the first motor 71 to the shaft member 42. Consequently, the feed rollers 41 rotate in response to the rotation of the first motor 71.

The second motor 72 is disposed in a left portion of the first casing 11. The second motor 72 has a rotational shaft that extends leftward. The transmission mechanism 72A is positioned to the left of the second motor 72. The transmission mechanism 72A includes gears 721, 722, and the like; and a belt 723. The belt 723 is looped around the gears 721 and 722. The gears 721, 722, and the like rotate and the belt 723 moves in response to the rotation of the second motor 72. The gear 721 is connected to a left end portion of the shaft member 91A of the conveying rollers 91. The gear 722 is connected to a left end portion of the shaft member 92A of the conveying rollers 92. The transmission mechanism 72A transmits a drive force of the second motor 72 to the shaft member 91A and the shaft member 92A. Consequently, the conveying rollers 91 and 92 rotate in response to the rotation of the second motor 72.

Hereinafter, a direction in which the second motor 72 rotates in order to rotate the conveying rollers 91 and 92 counterclockwise will be referred to as a first direction, while a direction opposite the first direction will be referred to as a second direction. When the conveying rollers 91 and 92 rotate counterclockwise, the outer circumferential surfaces of the conveying rollers 91 and 92 verging on the conveying path 20 move downstream. Thus, when the second motor 72 is rotated in the first direction while the conveying rollers 91 and 92 are in contact with a sheet placed in the conveying path 20, the conveying rollers 91 and 92 convey the sheet downstream.

The gear 722 has an internal one-way clutch. When the second motor 72 rotates in the first direction, the one-way clutch of the gear 722 transmits the drive force of the second motor 72 to the shaft member 92A, causing the conveying rollers 92 to rotate counterclockwise. However, when the second motor 72 rotates in the second direction, the one-way clutch of the gear 722 allows the shaft member 92A to freewheel relative to the gear 722. In this case, the drive force of the second motor 72 is not transmitted to the conveying rollers 92. The gear 721 does not possess a one-way clutch. Accordingly, when the second motor 72 rotates in the first direction, the gear 721 transmits the drive force of the second motor 72 to the shaft member 91A, causing the conveying rollers 91 to rotate counterclockwise. When the second motor 72 rotates in the second direction, the gear 721 transmits the drive force of the second motor 72 to the shaft member 91A, causing the conveying rollers 91 to rotate clockwise.

The transmission mechanism 73 has gears 73A, 73B, 73C, and 73D. The gear 73A is meshedly engaged with the gear 73B, the gear 73B is meshedly engaged with the gear 73C, and the gear 73C is meshedly engaged with the gear 73D. The gear 73A is connected to a right end portion of the shaft member 91A of the conveying roller 91. The gears 73A-73D rotate in response to the rotation of the shaft member 91A.

The transmission mechanism 74 has gears 74A, 74B, 74C, 74D, 74E, and 481; and the torque limiter 482. The gear 74A is meshedly engaged with the gear 73D of the transmission mechanism 73 when the second casing 12 is disposed in the closed position (see FIG. 1). The gear 74A is separated from the gear 73D of the transmission mechanism 73 when the second casing 12 is disposed in the open position (see FIG. 2). The following description will be based on the second casing 12 being in its closed position. The gear 74A is meshedly engaged with the gear 74B, the gear 74B is meshedly engaged with the gear 74C, the gear 74C is meshedly engaged with the gear 74D, and the gear 74D is meshedly engaged with the gear 74E.

The gear 74B is connected to the shaft member 47 of the reverse rollers 46 (see FIG. 4) via the gear 481 and the torque limiter 482. The drive force of the second motor 72 is transmitted to the reverse rollers 46 via the transmission mechanism 72A, the shaft member 91A, the transmission mechanism 73, the gears 74A, 74B, and 481, and the torque limiter 482.

The torque limiter 482 connects the gear 481 and the reverse rollers 46 while rotational torque applied to the reverse rollers 46 is within a prescribed threshold value. The torque limiter 482 disconnects the gear 481 and the reverse rollers 46 when a rotational torque applied to the reverse roller 46 exceeds the prescribed threshold value.

The gear 74E is connected to the shaft member 851 of the drive portion 85. Thus, the drive force of the second motor 72 is transmitted to the drive portion 85 via the transmission mechanism 72A, the shaft member 91A, and the transmission mechanisms 73 and 74. The gear 74E has an internal one-way clutch. When the second motor 72 rotates in the second direction, the one-way clutch of the gear 74E transmits the drive force of the second motor 72 to the shaft member 851, causing the cam 853 to rotate clockwise. However, when the second motor 72 rotates in the first direction, the one-way clutch of the gear 74E allows the shaft member 851 to freewheel relative to the gear 74E. In this case, the drive force of the second motor 72 is not transmitted to the cam 853.

The transmission mechanism 75 includes gears 75A, 75B, 75C, and 75D. The gear 74E of the transmission mechanism 74 is meshedly engaged with the gear 75A, the gear 75A is meshedly engaged with the gear 75B, the gear 75B is meshedly engaged with the gear 75C, and the gear 75C is meshedly engaged with the gear 75D.

The gear 75D is connected to the shaft member 61 of the cam portion 60. The drive force of the second motor 72 is transmitted to the cam portion 60 via the transmission mechanism 72A, the shaft member 91A, and the transmission mechanisms 73, 74, and 75. The gear 75D has an internal one-way clutch. When the second motor 72 rotates in the second direction, the one-way clutch of the gear 75D transmits the drive force of the second motor 72 to the shaft member 61, causing the cams 62 to rotate clockwise. However, when the second motor 72 rotates in the first direction, the one-way clutch of the gear 75D allows the shaft member 61 to freewheel relative to the gear 75D. In this case, the drive force of the second motor 72 is not transmitted to the cams 62.

<Operations of Image-Reading Apparatus 1>

Next, operations of the image-reading apparatus 1 performed when the image-reading apparatus 1 conveys a plurality of sheets 35 and reads images from the plurality of sheets 35 will be described with reference to FIG. 26.

First, the control section 131 (see FIG. 1) drives the second motor 72 (see FIG. 24) to rotate in the second direction. When the second motor 72 rotates in the second direction, the one-way clutch of the gear 722 of the transmission mechanism 72A (see FIG. 24) allows the shaft member 92A (see FIG. 24) to freewheel relative to the gear 722. Consequently, the drive force of the second motor 72 is not transmitted to the shaft member 92A and, hence, the conveying rollers 92 (see FIG. 3) do not rotate. However, when the second motor 72 rotates in the second direction, the gear 721 of the transmission mechanism 72A (see FIG. 24) rotates the shaft member 91A clockwise. Accordingly, the drive force of the second motor 72 is transmitted to the shaft member 91A (see FIG. 24), rotating the conveying rollers 91 (see FIG. 3) clockwise.

The drive force of the second motor 72 is transmitted to the gear 481 (see FIG. 24) via the transmission mechanism 72A, the shaft member 91A, the transmission mechanism 73 (see FIG. 24), and the gears 74A and 74B of the transmission mechanism 74 (see FIG. 24). As a result, the reverse rollers 46 rotate clockwise.

The drive force of the second motor 72 is also transmitted to the gear 74E via the transmission mechanism 72A, the shaft member 91A, the transmission mechanism 73, and the gears 74A-74D of the transmission mechanism 74 (see FIG. 24). When the second motor 72 rotates in the second embodiment, the one-way clutch of the gear 74E transmits the drive force of the second motor 72 to the shaft member 851 of the drive portion 85 (see FIG. 17). Accordingly, the cam 853 of the drive portion 85 (see FIG. 17) rotates clockwise against the urging force of the spring 852 (see FIG. 17).

Figure 21:
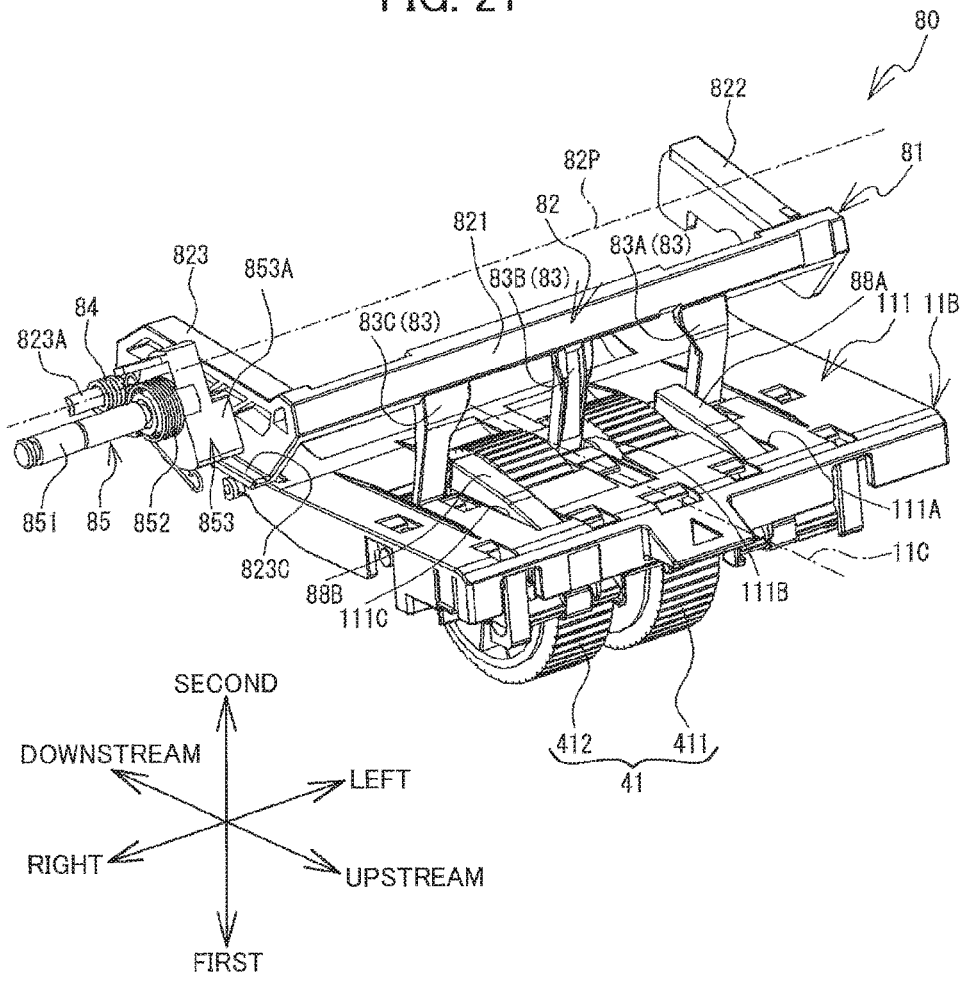
FIG. 21 is a perspective view of the shutter mechanism 80 that includes the shutter 81 disposed in a restricting position.

When the cam 853 rotates clockwise, the protruding part 853A of the cam 853 forces the support member 82 of the shutter 81 to rotates clockwise against the urging force of the spring 84 (see FIGS. 21-23). As shown in FIG. 26, the shutter 81 is set in the restricting position (indicated by an arrow 311). In this position, the extension member 83 of the shutter 81 protrudes through the second surface 12A of the second casing 12 into the conveying region 10C. The extension member 83 crosses the conveying path 20 from the second side to the first side. The extension parts 83A and 83C press downward on the first members 87A and 87B of the set guides 86A and 86B, respectively (see FIGS. 21-23). Consequently, the second members 88A and 88B are pushed upward. At this time, downstream portions of the second-side surfaces 882 of the second members 88A and 88B are moved further toward the second side than the conveying path 20 (indicated by an arrow 312).

The drive force of the second motor 72 is also transmitted to the gear 75D via the transmission mechanism 72A, the shaft member 91A, the transmission mechanisms 73 and 74, and the gears 75A-75C of the transmission mechanism 75 (see FIG. 24). When the second motor 72 rotates in the second direction, the one-way clutch of the gear 75D transmits the drive force of the second motor 72 to the shaft member 61 of the cam portion 60. Accordingly, the shaft member 61 and the cams 62 rotate clockwise (indicated by an arrow 313) against the urging force of the spring 63 (see FIG. 24). When the cams 62 rotate clockwise, the cam end 621A of the cam 621 contacts the plate-shaped part 5211 of the pressing portion 51 from below, and the cam end 622A of the cam 622 contacts the plate-shaped part 5221 of the pressing portion 51 from below. As the cams 62 rotate, a force in the direction toward the far side is applied to the pressing portion 51. Consequently, the pressing portion 51 moves to the second position (indicated by an arrow 314) against the urging forces of the first spring 54 and the urging portion 55. In the second position, the pressing portion 51 is positioned on the far side relative to the second surface 12A of the second casing 12 and further toward the far side than the conveying region 10C. The pressure rollers 52D do not protrude into the conveying region 10C through the second surface 12A at this time.

While the image-reading apparatus 1 is in this state, the user places the plurality of sheets 35 on the tray surfaces 171, 172, and 173 of the paper tray 16. A bottommost sheet 351 of the plurality of sheets 35 contacts the tops of the contact members 17. The plurality of sheets 35 move downstream along the conveying path 20, and enter the conveying region 10C through the feed opening 10A.

As the plurality of sheets 35 move downstream, the first extension member 67 of the rotary member 65 is pressed downstream, rotating the shaft member 66 of the rotary member 65 clockwise (indicated by an arrow 315). At this time, the distal end 68A of the second extension member 68 (see FIG. 13) is positioned on the second side relative to the light-emitting portion 691A and the light-receiving portion 691B of the photosensor 691 (see FIG. 13). Thus, light emitted from the light-emitting portion 691A is received by the light-receiving portion 691B, and the photosensor 691 outputs a signal indicative of the detection results to the control section 131 (see FIG. 1).

Figure 26:
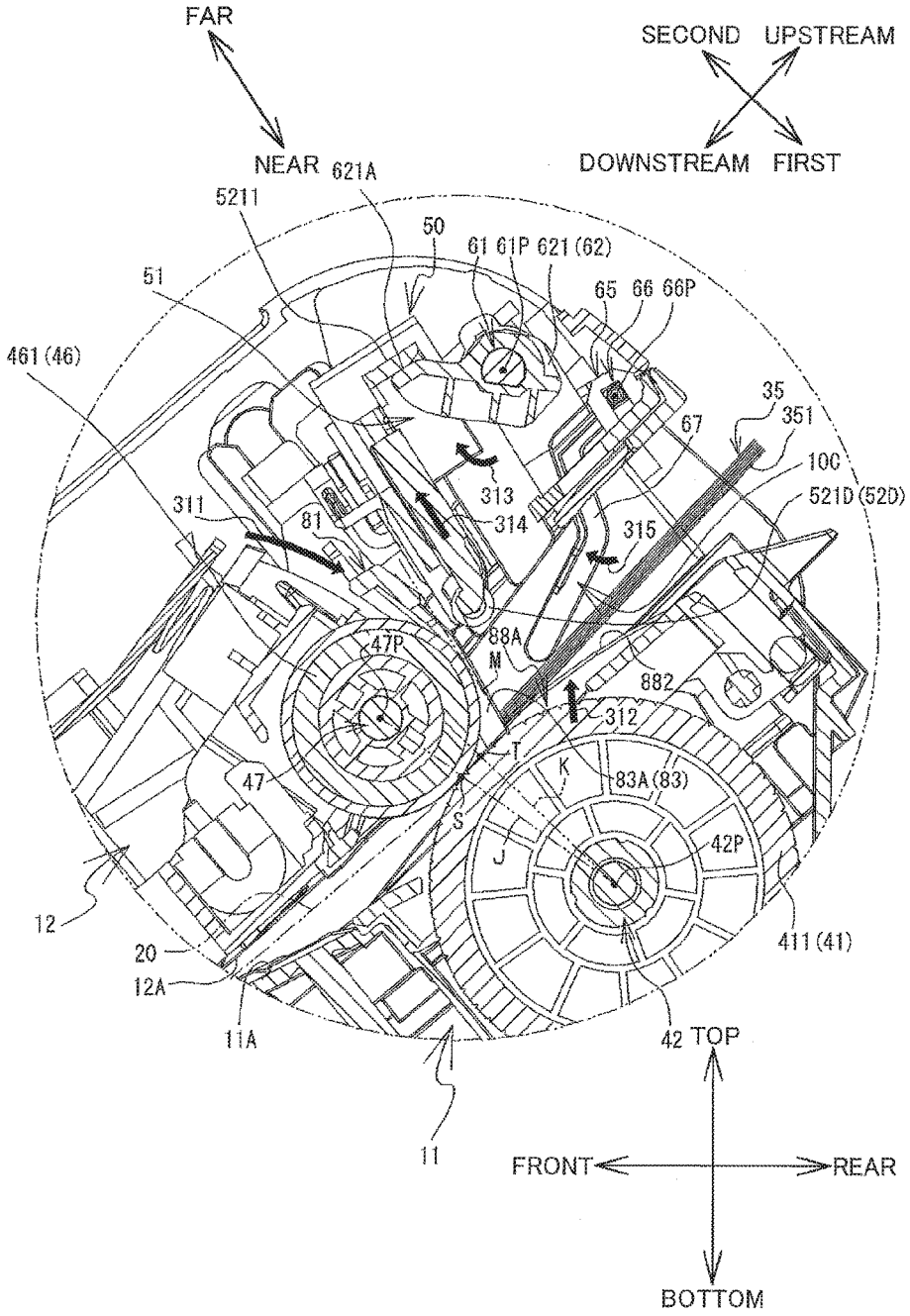
FIG. 26 is a partial enlarged cross-sectional view taken along the center line 11C as viewed from a right side thereof, in which a plurality of sheets 35 is set in a paper tray 16.

In FIG. 26, the pressing portion 51 is disposed in the second position. Hence, the plurality of sheets 35 entered into the conveying region 10C through the feed opening 10A does not contact the pressure rollers 52D of the pressing portion 51. Downstream portions of the second-side surfaces 882 of the second members 88A and 88B of the set guide 86 are positioned further toward the second side than the conveying path 20. Hence, as the plurality of sheets 35 moves downstream along the conveying path 20, the plurality of sheets 35 contacts the second-side surfaces 882 of the second members 88A and 88B but do not contact the feed rollers 41. Further, the shutter 81 is in the restricting position, whereby the extension member 83 crosses the conveying path 20 at a position upstream of the contact points S between the feed rollers 41 and the corresponding reverse rollers 46. Thus, the extension member 83 restricts the plurality of sheets 35 from moving downstream, thereby preventing the plurality of sheets 35 from reaching the contact points S between the feed rollers 41 and the corresponding reverse rollers 46.

Here, an example will be described for a case in which the user performs an operation through the operating section 122 (see FIG. 1) to initiate reading of the plurality of sheets 35 with reference to FIG. 27.

First, the control section 131 rotates the first motor 71. The transmission mechanism 71A transmits the drive force of the first motor 71 to the shaft member 42, causing the feed rollers 41 to rotate counterclockwise (indicated by an arrow 321). The control section 131 also rotates the second motor 72 in the first direction. When the second motor 72 rotates in the first direction, the one-way clutch of the gear 722 of the transmission mechanism 72A transmits the drive force of the second motor 72 to the shaft member 92A. Consequently, the conveying rollers 92 rotate counterclockwise. When the second motor 72 is rotated in the first direction, the gear 721 of the transmission mechanism 72A rotates the shaft member 91A counterclockwise. Accordingly, the drive force of the second motor 72 is transmitted to the shaft member 91A, rotating the conveying rollers 91 counterclockwise.

The drive force of the second motor 72 is also transmitted to the gear 481 (see FIG. 24) via the transmission mechanism 72A, the shaft member 91A, the transmission mechanism 73, and the gears 74A and 74B of the transmission mechanism 74. When the second motor 72 rotates in the first direction, the gear 481 transmits the drive force of the second motor 72 to the shaft member 47. As a result, the reverse rollers 46 rotate counterclockwise (indicated by an arrow 322).

The drive force of the second motor 72 is also transmitted to the gear 74E via the transmission mechanism 72A, the shaft member 91A, the transmission mechanism 73, and the gears 74A-74D of the transmission mechanism 74. When the second motor 72 is rotated in the first direction, the one-way clutch of the gear 74E allows the shaft member 851 of the drive portion 85 to freewheel relative to the gear 74E. Accordingly, the cam 853 of the drive portion 85 is rotated counterclockwise by the urging force of the spring 852.

When the cam 853 is rotated counterclockwise, the urging force of the spring 84 rotates the shutter 81 counterclockwise (indicated by an arrow 323). This operation places the shutter 81 in the permitting position (see FIGS. 17-20). In this position, the extension parts 83A and 83C are separated from the first members 87A and 87B of the corresponding set guides 86A and 86B. The first members 87A and 87B are rotated clockwise by the weight of their upstream ends 872. Consequently, the second-side surfaces 882 of the second members 88A and 88B move further toward the first side than the first-side surface 111 of the support member 11B (indicated by an arrow 324).

The drive force of the second motor 72 is also transmitted to the gear 75D via the transmission mechanism 72A, the shaft member 91A, the transmission mechanisms 73 and 74, and the gears 75A-75C of the transmission mechanism 75. When the second motor 72 rotates in the first direction, the one-way clutch of the gear 75D allows the shaft member 61 of the cam portion 60 to freewheel relative to the gear 75D. Accordingly, the shaft member 61 and the cams 62 rotate counterclockwise (indicated by an arrow 325) by the urging force of the spring 63 (see FIG. 24). When the cams 62 rotate counterclockwise, the cam end 621A of the cam 621 separates from the plate-shaped part 5211 of the pressing portion 51, and the cam end 622A of the cam 622 separates from the plate-shaped part 5221 of the pressing portion 51. Consequently, the pressing portion 51 receives the urging forces from the first spring 54 and the urging portion 55 in the direction toward the near side. Hence, the pressing portion 51 moves toward the near side (indicated by an arrow 326). Thus, the pressing portion 51 protrudes through the second surface 12A of the second casing 12 into the conveying region 10C.

Figure 27:
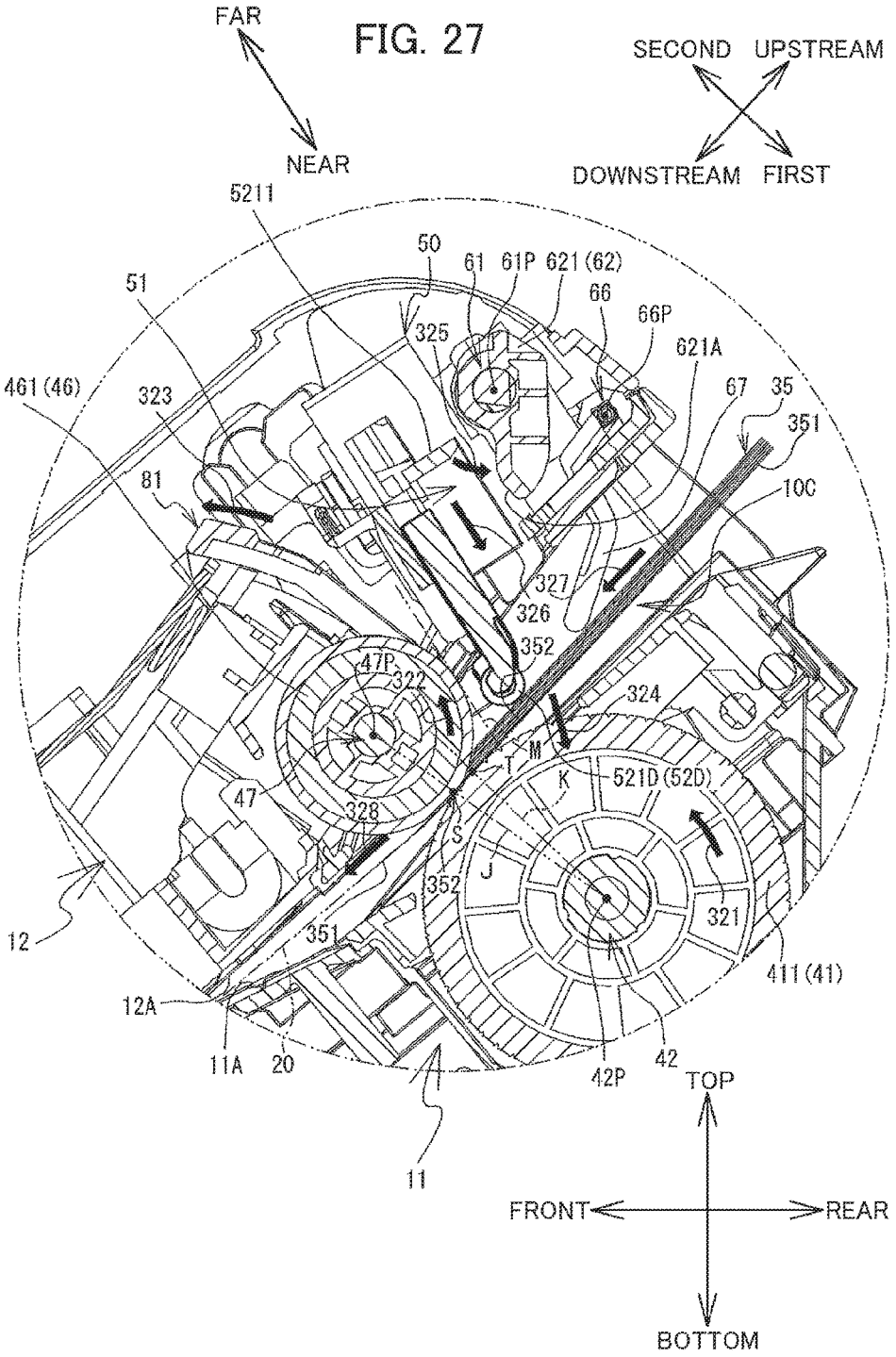
FIG. 27 is a partial enlarged cross-sectional view taken along the center line 11C as viewed from a right side thereof, in which the plurality of sheets 35 is set in the paper tray 16.

When the shutter 81 has moved to the permitting position shown in FIG. 27, the plurality of sheets 35 is allowed to move downstream along the conveying path 20. Since the second-side surfaces 882 of the second members 88A and 88B of the set guide 86 are positioned further toward the first side relative to the conveying path 20, the feed rollers 41 contact the bottommost sheet 351 of the plurality of sheets 35 moving downstream along the conveying path 20 from the first side thereof. Further, as the pressing portion 51 moves toward the near side from the second position, the pressure rollers 52D contact the plurality of sheets 35 from the second side. The pressure rollers 52D press the plurality of sheets 35 against the feed rollers 41 as the first spring 54 and the urging portion 55 urge the pressing portion 51. When the feed rollers 41 rotate counterclockwise, the plurality of sheets 35 moves downstream along the conveying path 20 (indicated by an arrow 327) until the downstream ends of the plurality of sheets 35 reach the contact points S between the feed rollers 41 and the corresponding reverse rollers 46.

Here, the bottommost sheet 351 of the plurality of sheets 35 and a sheet 352 positioned above the bottommost sheet 351 become nipped between the reverse rollers 46 and the corresponding feed rollers 41 at the contact points S. By rotating the reverse rollers 46 counterclockwise, the sheets 351 and 352 can be separated. As the feed rollers 41 rotate counterclockwise, the bottommost sheet 351 moves past the contact points S (indicated by an arrow 328) while moving downstream. The sheet 352 and any sheets 35 positioned above the sheet 352 remain upstream of the contact points S.

The bottommost sheet 351 conveyed downstream of the contact points S moves downstream along the conveying path 20. The conveying rollers 91 contact a bottom surface of the sheet 351 moving along the conveying path 20 and continue to convey the sheet 351 further downstream. The image-reading section 93 disposed downstream of the conveying rollers 91 (see FIG. 3) reads an image on the bottom surface of the sheet 351. The control section 131 receives output signals transmitted from the image-reading section 93 and converts the signals to digital data.

The conveying rollers 92 contact the bottom surface of the sheet 351 exiting the image-reading section 93 and continue to convey the sheet 351 further downstream. The conveying rollers 92 discharge the sheet 351 from the casing 10 through the discharge opening 10B (see FIG. 1) and into the discharge tray 18 (see FIG. 1).

Next, an example will be described for a case in which only one sheet is positioned upstream of the contact points S. In this case, the feed rollers 41 contact the sheet from the first side while the reverse rollers 46 contact the sheet from the second side. As the feed rollers 41 rotate counterclockwise, the feed rollers 41 apply a force in a downstream direction to the sheet, thereby applying torque to the reverse rollers 46 contacting the sheet from the second side. The torque limiter 482 (see FIG. 24) interrupts the transmission of the drive force between the reverse rollers 46 and the gear 481 based on the torque being applied. In this case, the drive force of the second motor 72 is not transmitted to the reverse rollers 46, allowing the reverse rollers 46 to rotate clockwise along with the downstream movement of the sheet. In this way, the feed rollers 41 and the reverse rollers 46 can convey a single sheet.

<Operational Advantages>

In the image-reading apparatus 1 according to the embodiment, the pressing portion 51 presses the plurality of sheets 35 against the feed rollers 41, and the feed rollers 41 convey the sheets 35 along the conveying path 20. The reverse rollers 46 restrain the sheets 35 other than the single bottommost sheet 351 so that the bottommost sheet 351 can be separated from the other sheets 35. The shutter 81 restricts conveyance of the sheets 35. Further, the reverse rollers 46 and the pressing portion 51 both confront the feed rollers 41.

Providing an additional mechanism between the reverse rollers 46 and the pressing portion 51 would require that a larger gap be formed between the reverse rollers 46 and the pressing portion 51. In order that both the reverse rollers 46 and the pressing portion 51 can be positioned to confront the feed rollers 41 with this larger gap, the portion of each feed roller 41 that protrudes through the first surface 11A into the conveying region 10C must have a greater circumferential length than the distance of separation between the reverse rollers 46 and the pressing portion 51. However, increasing the diameter of the feed rollers 41 would necessitate an increase in the size of the image-reading apparatus 1 itself.

With the image-reading apparatus 1 according to the embodiment, the imaginary line 82P denoting the rotational center position of the shutter 81 is disposed downstream of the reverse rollers 46 and the feed rollers 41. In other words, the imaginary line 82P is not positioned in an area between the reverse rollers 46 and the pressing portion 51. Further, the shaft member 61 extending along the rotational center of the cam portion 60 is disposed upstream of the pressing portion 51. Thus, the shaft member 61 is also not positioned in the area between the reverse rollers 46 and the pressing portion 51. Therefore, the image-reading apparatus 1 can avoid positioning the mechanism for moving the pressing portion 51 between the reverse rollers 46 and the pressing portion 51, thereby avoiding an increase in the size of the image-reading apparatus 1 in the conveying direction.

Further, the shaft member 66 of the rotary member 65 is disposed upstream from the shaft member 61 of the cam portion 60. This arrangement avoids positioning the rotary member 65 in the area between the reverse rollers 46 and the pressing portion 51, thereby further suppressing an increase in the size of the image-reading apparatus 1 in the conveying direction.

If the shaft member 66 of the rotary member 65 were disposed on the first side relative to the conveying region 10C, i.e., within the first casing 11, a spring or other urging member would be required for urging the shaft member 66 to rotate in order to protrude the first extension member 67 into the conveying region 10C. However, this arrangement is not preferable since the force applied by the urging member to the shaft member 66 may cause the sheets 35 to rise up from the conveying path 20. In the image-reading apparatus 1 according to the embodiment, the shaft member 66 is provided on the second side relative to the conveying region 10C, i.e., within the second casing 12. With this configuration, the first extension member 67 can protrude into the conveying region 10C using the weight of the second extension member 68. Therefore, the image-reading apparatus 1 can appropriately detect the plurality of sheets 35 with the rotary member 65, even when the sheets 35 are thin sheets.

As described above, the second extension member 68 of the rotary member 65 is disposed leftward of one end (e.g. a left end) of the pressing portion 51. With this arrangement, the photosensor 691 used to detect the distal end 68A of the second extension member 68 can be disposed leftward from the left end of the pressing portion 51. Accordingly, this configuration can suppress an increase in the size of the image-reading apparatus 1 in the conveying direction more effectively than an arrangement in which the photosensor 691 is positioned between the reverse rollers 46 and the pressing portion 51.

The rotational drive force of the second motor 72 is transmitted to the shaft member 851 of the drive portion 85 via the transmission mechanism 72A, the shaft member 91A, the transmission mechanism 73, and the gears 74A-74E of the transmission mechanism 74 in order to drive the shutter 81. The drive force of the second motor 72 is also transmitted to the shaft member 61 of the cam portion 60 via the transmission mechanism 72A, the shaft member 91A, and the transmission mechanisms 73, 74, and 75. Hence, the image-reading apparatus 1 can use the drive force of the second motor 72 for moving the shutter 81 and the cam portion 60.

In the image-reading apparatus 1 according to the embodiment, the shutter 81 is moved to the restricting position when the second motor 72 rotates in the second direction. In this position, the shutter 81 can restrict the sheets 35 from being conveyed downstream. The cams 62 are also rotated to move the pressing portion 51 to the second position when the second motor 72 rotates in the second direction. In this way, the image-reading apparatus 1 can enter a state in which the plurality of sheets 35 are not conveyed downstream, by operating the shutter 81 and the pressing portion 51 together in response to the rotation of the second motor 72 in the second direction.

On the other hand, when the second motor 72 rotates in the first direction, the image-reading apparatus 1 transmits the drive force of the second motor 72 to the reverse rollers 46 such that the portions of the outer circumferential surfaces of the reverse rollers 46 nearest the corresponding feed rollers 41 move upstream in the conveying direction. As the reverse rollers 46 are rotated by the transmitted drive force from the second motor 72, the reverse rollers 46 can separate the bottommost sheet 351 from the other sheets 35. Further, the drive force of the second motor 72 is not transmitted to the shutter 81 and the cam portion 60 when the second motor 72 rotates in the first direction. Accordingly, the shutter 81 is moved to the permitting position by the urging force of the spring 84. The cam portion 60 is rotated by the urging force of the spring 63 and is separated from the pressing portion 51. As a result, the pressing portion 51 is moved to the first position by the urging forces of the first spring 54 and the second springs 57. Thus, the image-reading apparatus 1 can control the reverse rollers 46, the shutter 81, and the pressing portion 51 in response to the rotation of the second motor 72 in the first direction in order to separate the bottommost sheet 351 from the other sheets 35 and to convey the bottommost sheet 351 downstream.

The second springs 571 and 572 are arranged to be symmetrical in the left-right direction about the center of the first spring 54. Accordingly, the second springs 571 and 572 can apply a uniform urging force to the pressing portion 51 at balanced positions relative to the left-right direction when the cam portion 60 moves the pressing portion 51 from the first position to the second position. As a result, this configuration can suppress the generation of rotation moment (torque) in the pressing portion 51 caused by the force that the pressing portion 51 receives from the cam portion 60. Therefore, the image-reading apparatus 1 can prevent the pressing portion 51 from rotating due to the urging forces of the first spring 54 and the second springs 571 and 572 and, hence, from interfering with peripheral parts to the pressing portion 51. In this way, the image-reading apparatus 1 can move the pressing portion 51 smoothly from the first position to the second position.

As described above, the position at which the cams 62 contact the pressing portion 51 is substantially equivalent in the conveying direction to the positions at which the first spring 54 and the urging portion 55 contact and urge the pressing portion 51. Accordingly, the point at which the cam portion 60 applies a force to the pressing portion 51 when moving the pressing portion 51 from the first position to the second position and the points at which the first spring 54 and the urging portion 55 apply forces to the pressing portion 51 for moving the pressing portion 51 from the second position to the first position are equivalent positions relative to the conveying direction. Therefore, this arrangement suppresses the generation of rotation moment in the pressing portion 51 when the cam portion 60 applies a force to the pressing portion 51 that opposes the urging forces of the first spring 54 and the urging portion 55. Accordingly, the image-reading apparatus 1 can prevent the pressing portion 51 from rotating due to the forces applied by the first spring 54, the urging portion 55, and the cam portion 60 and, hence, from interfering with peripheral parts to the pressing portion 51. In this way, the image-reading apparatus 1 can move the pressing portion 51 smoothly from the first position to the second position.

When the shutter 81 is disposed in the restricting position, the upstream edge of the shutter 81 (the upstream surface of the extension member 83) in the conveying direction is disposed upstream of the contact points S between the feed rollers 41 and the corresponding reverse rollers 46 and downstream of the pressure rollers 52D of the pressing portion 51 disposed in the first position in the conveying direction. With the image-reading apparatus 1 having this configuration, the shutter 81 can suppress the plurality of sheets 35 pressed by the pressure rollers 52D of the pressing portion 51 from being moved by the feed rollers 41 downstream toward the reverse rollers 46.

The feed rollers 41 is disposed on the first side relative to the conveying path 20, while the reverse rollers 46, the pressing portion 51, the shutter 81 disposed in the permitting position, and the cam portion 60 are disposed on the second side relative to the conveying path 20. With this arrangement, the feed rollers 41 can separate the bottommost sheet 351 from the other sheets 35 nipped between the feed rollers 41 and the reverse rollers 46. Further, the pressing portion 51 can ensure that the bottommost sheet 351 is in contact with the feed rollers 41 when the plurality of sheets 35 is nipped between the feed rollers 41 and the pressing portion 51. Hence, the image-reading apparatus 1 can convey the bottommost sheet 351 by rotating the feed rollers 41.

Further, the shutter 81 is disposed on the opposite side of the conveying path 20 from the feed rollers 41 when in the permitting position. In this way, both the shutter 81 and the imaginary line 82P, which is the rotational center of the shutter 81, can be arranged in the second casing 12, i.e., on the same side of the conveying path 20. This arrangement enables the image-reading apparatus 1 to be made more compact than when the imaginary line 82P of the shutter 81 is positioned in the first casing 11, i.e., on the same side of the conveying path 20 as the feed rollers 41. Further, by arranging the cam portion 60 on the same side of the conveying path 20 as the pressing portion 51, the mechanism for transmitting the drive force of the cam portion 60 to the pressing portion 51 can be smaller, thereby suppressing an increase in the size of the image-reading apparatus 1.

In the casing 10 described above, the conveying region 10C is formed between the first surface 11A of the first casing 11 and the second surface 12A of the second casing 12. Hence, the casing 10 can be configured such that an area formed between the first surface 11A and the second surface 12A serves as the conveying region 10C through which the plurality of sheets 35 passes. Further, the feed rollers 41 protrude into the conveying region 10C from the first surface 11A, while the reverse rollers 46 protrudes into the conveying region 10C from the second surface 12A. When the plurality of sheets 35 are nipped between the feed rollers 41 and the reverse rollers 46 in the conveying region 10C, the feed rollers 41 can separate the bottommost sheet 351 from the other sheets 35. Further, the pressing portion 51 protrudes into the conveying region 10C from the second surface 12A when in the first position. Accordingly, the pressing portion 51 can place the bottommost sheet 351 in contact with the feed rollers 41 within the conveying region 10C so that the rotating feed rollers 41 can convey the bottommost sheet 351. Further, when the shutter 81 is in the restricting position, the shutter 81 protrudes into the conveying region 10C from the second surface 12A and restricts the plurality of sheets 35 from moving downstream. Further, the cam portion 60 is arranged at a position separated from the second surface 12A, thereby preventing the cam portion 60 from interfering with conveyance of the sheets 35.

<Variations of the Embodiment>

While the description has been made in detail with reference to the embodiments thereof, it would be apparent to those skilled in the art that many modifications and variations may be made therein without departing from the spirit of the present disclosure.

For example, the image-reading apparatus 1 may have only a function for conveying sheets. In this case, the image-reading apparatus 1 needs not possess the image-reading section 93. The conveying path 20 may have a planar shape throughout the entire region of the imaginary plane surface 20A and the imaginary surface 20B, or may be curved while extending through the entire region of the imaginary plane surface 20A and the imaginary surface 20B. The mechanism for separating one sheet from the plurality of sheets is not limited to the reverse rollers 46. For example, a plate-shaped member(s) that contacts the plurality of sheets may be used in place of the reverse rollers 46.

In the embodiment described above, the shaft member 66 of the rotary member 65 is disposed upstream of the pressing mechanism 50 in the conveying direction. The shaft member 66 is also disposed diagonally upstream of and below the shaft member 61 of the cam portion 60. However, the shaft member 66 may be arranged downstream of the pressing portion 51 and upstream of the reverse rollers 46 or may be disposed downstream of the reverse rollers 46.

In the embodiment described above, the rotary member 65 has the shaft member 66, the first extension member 67, and the second extension member 68. The second extension member 68 is disposed leftward of the protruding member 521 of the pressing mechanism 50. However, the second extension member 68 may be disposed rightward of the protruding member 522 of the pressing mechanism 50. Further, the second extension member 68 may be disposed between the protruding members 521 and 522. In the embodiment described above, the first extension member 67 and the second extension member 68 extend from the shaft member 66 in different directions from each other. However, the first extension member 67 and the second extension member 68 may extend in the same direction from the shaft member 66.

In the embodiment described above, the drive force of the second motor 72 is transmitted to the shaft member 851 of the drive portion 85 to drive the shutter 81. The drive force of the second motor 72 is further transmitted to the shaft member 61 of the cam portion 60 to drive the cams 62. However, the shutter 81 and the cam portion 60 may be driven by separate motors.

In the embodiment described above, the drive force of the second motor 72 is transmitted to the reverse rollers 46. However, the reverse rollers 46 may be driven by a different motor. Further, while the gear 74E has an internal one-way clutch, the gear 74E need not possess a one-way clutch. The gear 74E may rotate the shaft member 851 counterclockwise in response to the rotation of the second motor 72 in the first direction in order to move the shutter 81 to the permitting position. Further, in the above embodiment, the gear 75D also has an internal one-way clutch. However, the gear 75D need not possess a one-way clutch. The gear 75D may rotate the shaft member 61 and the cams 62 counterclockwise in response to the rotation of the second motor 72 in the first direction.

In the embodiment described above, the first spring 54 is arranged in the left-right center of the pressing portion 51, and the cams 621 and 622 of the cam portion 60 are arranged so as to be symmetrical in the left-right direction about the first spring 54. However, the cam portion 60 may be provided with only one cam instead. This single cam may be arranged in the left-right center of the pressing portion 51. The single cam may be configured to contact the bridging member 53 from the near side when rotated clockwise in order to move the pressing portion 51 toward the far side.

In the embodiment described above, the cams 62 contact the pressing portion 51 at the plate-shaped parts 5211 and 5212. The first spring 54 is connected to the bridging member 53 and interposed between the plate-shaped parts 5211 and 5212 in the left-right direction. Accordingly, the position at which the first spring 54 contacts the pressing portion 51 is equivalent to the positions at which the cams 62 contact the pressing portion 51 in the conveying direction. However, the cams 62 may contact the pressing portion 51 at positions upstream of or downstream of the first spring 54 in the conveying direction.

In the embodiment described above, when the shutter 81 is in the restricting position, the upstream edge of the shutter 81 (the upstream surface of the extension member 83) in the conveying direction is positioned upstream of the contact points S between the feed rollers 41 and the corresponding reverse rollers 46 and downstream of the pressure rollers 52D of the pressing portion 51 disposed in the first position in the conveying direction. However, the upstream edge of the shutter 81 in the restricting position may be positioned upstream of the pressure rollers 52D of the pressing portion 51 in the first position. Note that the pressing portion 51 is disposed in the second position when the shutter 81 is in the restricting position. Accordingly, the upstream edge of the shutter 81 in the restricting position will not make contact with the pressing portion 51 disposed in the first position even when arranged upstream of the pressing portion 51.

In the embodiment described above, the conveying region 10C is formed between the first surface 11A of the first casing 11 and the second surface 12A of the second casing 12. However, the conveying region 10C need not be enclosed on both sides by surfaces. For example, the conveying region 10C may be defined as being above the first surface 11A of the first casing 11, and the second casing 12 may not be provided. In this case, support members for supporting the reverse rollers 46, the pressing mechanism 50, and the shutter mechanism 80 may be provided on the second side of the first casing 11 in place of the second casing 12.

In the embodiment described above, the reverse rollers 46, the pressing portion 51, the shutter 81 in the restricting position, and the cam portion 60 are disposed on the second side relative to the conveying path 20. However, the shutter 81 in the restricting position and the cam portion 60 may be disposed on the first side relative to the conveying path 20 instead.

In the above embodiment and variations, the feed roller 41 is an example of a first roller; the reverse roller 46 is an example of a separation member; the restricting position of the shutter 81 is an example of a first position; the permitting position of the shutter 81 is an example of a second position; the first position of the pressing portion 51 is an example of a third position; the second position of the pressing portion 51 is an example of a fourth position; the photosensor 691 is an example of a sensor; a combination of the transmission mechanism 72A, the shaft member 91A, the transmission mechanism 73, and the transmission mechanism 74 is an example of a first transmission mechanism; a combination of the transmission mechanism 72A, the shaft member 91A, the transmission mechanism 73, the transmission mechanism 74, and the transmission mechanism 75 is an example of a second transmission mechanism; a combination of the gear 74A, the gear 74B, and the gear 481 is an example of a third transmission mechanism; the gear 74E is an example of a first switching portion; the gear 75D is an example of a second switching portion; the first spring 54 is an example of a spring; the sheet 35 is an example of a medium; and the left-right direction is an example of an axial direction.

What is claimed is:

1. A sheet feeder comprising:

a casing defining therein a conveying region through which a sheet is conveyed in a conveying direction;

a first roller having a first rotation axis extending in an axial direction crossing the conveying direction and rotatable about the first rotation axis, the first roller having a portion exposed to the conveying region, the first roller having a center portion in the axial direction;

a separation member contacting the first roller in the conveying region at a contact position;

a pressing portion positioned upstream of the separation member in the conveying direction, the pressing portion being linearly movable between a first position and a second position in a linear-moving direction crossing the conveying region, the pressing portion in the first position facing the first roller within the conveying region, the pressing portion in the second position being separated from the first roller farther than in the first position, the pressing portion having one end portion and a center portion in the axial direction;

a cam portion having a second rotation axis extending in the axial direction and rotatable about the second rotation axis, the second rotation axis being positioned upstream of the pressing portion in the conveying direction, the cam portion being configured to contact the pressing portion to linearly move the pressing portion in the linear-moving direction, the cam portion being positioned upstream of the pressing portion in the conveying direction, the second rotation axis is positioned on a prescribed side relative to the conveying region;

a rotary member having a third rotation axis extending in the axial direction and rotatable about the third rotation axis, the third rotation axis being positioned upstream of the second rotation axis and positioned on the prescribed side relative to the conveying region, the rotary member including:

a shaft member extending parallel to the third rotation axis;

a first extension member extending from the shaft member in a first extending direction, the first extension member being arranged at a position coincident with the center portion of the first roller in the axial direction; and a second extension member extending from the shaft member in a second extending direction different from the first extending direction, the second extension member being arranged at a position away from the center portion of the pressing portion farther than the one end portion of the pressing portion from the center portion of the pressing portion in the axial direction; and a sensor configured to detect rotation of the rotary member.

2. The sheet feeder according to claim 1, further comprising:

a shutter having a fourth rotation axis extending in the axial direction and rotatable about the fourth rotation axis, the fourth rotation axis being positioned downstream of the separation member in the conveying direction, the shutter being movable between a third position and a fourth position in accordance with its rotation about the fourth rotation axis, the shutter in the third position having a portion positioned within the conveying region and upstream of the contact position in the conveying direction, the shutter in the fourth position being retracted from the conveying region;

a motor configured to generate a drive force; and a transmission mechanism including:

a first transmission mechanism configured to transmit the drive force from the motor to the shutter; and a second transmission mechanism configured to transmit the drive force from the motor to the cam portion.

3. The sheet feeder according to claim 2, wherein the motor is configured to rotate in a first direction, wherein the separation member includes a second roller rotatable upon transmission of the drive force from the motor, the second roller having a nearest edge nearest the first roller, and wherein the transmission mechanism further includes:

a torque limiter; and a third transmission mechanism configured to transmit the drive force from the motor to the second roller through the torque limiter such that the nearest edge of the second roller moves upstream in the conveying direction when the motor rotates in the first direction.

4. The sheet feeder according to claim 3, wherein the motor is configured to rotate in a second direction opposite to the first direction, wherein the first transmission mechanism includes a first switching portion configured to transmit the drive force from the motor to the shutter when the motor rotates in the second direction and configured to interrupt transmission of the drive force from the motor to the shutter when the motor rotates in the first direction, and wherein the shutter is configured to move from the fourth position to the third position when the motor rotates in the second direction to transmit the drive force from the motor to the shutter via the first transmission mechanism.

5. The sheet feeder according to claim 4, wherein the second transmission mechanism includes a second switching portion configured to transmit the drive force from the motor to the cam portion when the motor rotates in the second direction and configured to interrupt transmission of the drive force from the motor to the cam portion when the motor rotates in the first direction, and wherein the cam portion is configured to move the pressing portion from the first position to the second position when the motor rotates in the second direction to transmit the drive force from the motor to the cam portion via the second transmission mechanism.

6. The sheet feeder according to claim 1, further comprising a spring configured to urge the center portion of the pressing portion to move the pressing portion from the second position to the first position, wherein the cam portion includes two cams arranged at positions symmetrical about the spring in the axial direction.

7. The sheet feeder according to claim 6, wherein the cam portion contacts the pressing portion at a first contact position, wherein the spring contacts the pressing portion at a second contact position, and wherein the first contact position is coincident with the second contact position in the conveying direction.

8. The sheet feeder according to claim 1, further comprising a shutter having a fourth rotation axis extending in the axial direction and rotatable about the fourth rotation axis, the fourth rotation axis being positioned downstream of the separation member in the conveying direction, the shutter being movable between a third position and a fourth position in accordance with its rotation about the fourth rotation axis, the shutter in the third position having a portion positioned within the conveying region and upstream of the contact position in the conveying direction, the shutter in the fourth position being retracted from the conveying region, wherein the pressing portion in the first position has a nearest end nearest the first roller, and wherein the shutter in the third position has an upstream edge in the conveying direction, the upstream edge of the shutter in the third position being positioned upstream of the contact position and downstream of the nearest end of the pressing portion in the first position in the conveying direction.

9. The sheet feeder according to claim 1, further comprising a shutter having a fourth rotation axis extending in the axial direction and rotatable about the fourth rotation axis, the fourth rotation axis being positioned downstream of the separation member in the conveying direction, the shutter being movable between a third position and a fourth position in accordance with its rotation about the fourth rotation axis, the shutter in the third position having a portion positioned within the conveying region and upstream of the contact position in the conveying direction, the shutter in the fourth position being retracted from the conveying region, wherein the first roller is positioned opposite the separation member, the pressing portion, the shutter in the fourth position, and the cam portion with respect to the conveying region.

10. The sheet feeder according to claim 1, further comprising a shutter having a fourth rotation axis extending in the axial direction and rotatable about the fourth rotation axis, the fourth rotation axis being positioned downstream of the separation member in the conveying direction, the shutter being movable between a third position and a fourth position in accordance with its rotation about the fourth rotation axis, the shutter in the third position having a portion positioned within the conveying region and upstream of the contact position in the conveying direction, the shutter in the fourth position being retracted from the conveying region, wherein the casing has a first surface and a second surface, the conveying region being defined by the first surface and the second surface, wherein the first roller has a portion protruding from the first surface into the conveying region, wherein the separation member has a portion protruding from the second surface into the conveying region, wherein the pressing portion in the first position has a portion protruding from the second surface into the conveying region, wherein the shutter in the third position has a portion protruding from the second surface into the conveying region, and wherein the cam portion is disposed at a position away from the second surface and opposite the conveying region with respect to the second surface.

11. A sheet feeder comprising:

a casing including:

a first casing having a first surface; and a second casing connected to the first casing and movable relative to the first casing between an open position and a closed position, the second casing having a second surface, the second surface facing the first surface with a gap between the first surface and the second surface when the second casing is at the closed position, the casing defining a conveying path between the first surface and the second surface when the second casing is at the closed position;

a first roller having a portion protruding from the first surface, the first roller being configured to convey a medium in a conveying direction along the conveying path, the first roller having a roller rotation axis extending in an axial direction crossing the conveying direction and being rotatable about the roller rotation axis;

a shutter provided at the second casing, the shutter having a shutter rotation axis positioned downstream of the roller rotation axis in the conveying direction and extending parallel to the roller rotation axis, the shutter being rotatable about the shutter rotation axis, the shutter being movable between a first position and a second position in accordance with its rotation about the shutter rotation axis, the shutter in the first position having a portion positioned within the conveying path, the shutter in the second position being retracted from the conveying path;

a pressing portion provided at the second casing, the pressing portion being positioned upstream of the shutter in the first position in the conveying direction, the pressing portion being linearly movable between a third position and a fourth position in a direction crossing the conveying path, the pressing portion in the third position facing the first roller, the pressing portion in the fourth position being separated from the first roller farther than in the third position;

a cam portion provided at the second casing, the cam portion having a cam rotation axis extending parallel to the roller rotation axis and the shutter rotation axis, the cam portion being rotatable about the cam rotation axis, the cam rotation axis being positioned upstream of the pressing portion in the conveying direction, the cam portion being configured to contact the pressing portion to linearly move the pressing portion in the direction crossing the conveying path;

a motor configured to generate a drive force and configured to rotate in a first direction;

a separation member contacting the first roller on the conveying path, the separation member including a second roller rotatable upon transmission of the drive force from the motor, the second roller having a nearest edge nearest the first roller; and a transmission mechanism including:

a first transmission mechanism configured to transmit the drive force from the motor to the shutter;

a second transmission mechanism configured to transmit the drive force from the motor to the cam portion;

a torque limiter; and a third transmission mechanism configured to transmit the drive force from the motor to the second roller through the torque limiter such that the nearest edge of the second roller moves upstream in the conveying direction when the motor rotates in the first direction.

12. A sheet feeder comprising:

a pair of rollers arranged separated from each other in an axial direction and configured to convey a medium in a conveying direction through a conveying region, the pair of rollers having a first rotation axis extending in an axial direction crossing the conveying direction;

a separation member contacting the pair of rollers at a contact position;

a pressing portion positioned upstream of the separation member in the conveying direction, the pressing portion being linearly movable between a first position and a second position in a direction crossing the conveying region, the pressing portion in the first position facing the pair of rollers, the pressing portion in the second position being separated from the pair of rollers farther than in the first position, the pressing portion having one end portion and a center portion in the axial direction;

a cam portion having a second rotation axis and rotatable about the second rotation axis, the second rotation axis being positioned upstream of the pressing portion in the conveying direction, the cam portion being configured to contact the pressing portion to linearly move the pressing portion in the direction crossing the conveying region, the second rotation axis being positioned on a prescribed side relative to the conveying region;

a rotary member having a third rotation axis extending in the axial direction and rotatable about the third rotation axis, the third rotation axis being positioned upstream of the second rotation axis and positioned on the prescribed side relative to the conveying region, the rotary member including:

a shaft member extending parallel to the third rotation axis;

a first extension member extending from the shaft member in a first extending direction, the first extension member being arranged between the pair of rollers in the axial direction; and a second extension member extending from the shaft member in a second extending direction different from the first extending direction, the second extension member being arranged at a position away from the center portion of the pressing portion farther than the one end portion of the pressing portion from the center portion of the pressing portion in the axial direction; and a sensor configured to detect rotation of the rotary member.

* * * * *